US011173535B2

(12) United States Patent
Yokoyama et al.

(10) Patent No.: US 11,173,535 B2
(45) Date of Patent: Nov. 16, 2021

(54) DRILLING JIG AND DRILLING METHOD USING THIS DRILLING JIG

(71) Applicant: HONDA ACCESS CORP., Niiza (JP)

(72) Inventors: Shoji Yokoyama, Niiza (JP); Tomohiro Ogawa, Niiza (JP); Kazuya Takita, Niiza (JP); Ichiro Hosoya, Niiza (JP); Takashi Kumamoto, Niiza (JP); Yukio Kimura, Tokyo (JP)

(73) Assignee: HONDA ACCESS CORP., Niiza (JP)

( * ) Notice: Subject to any disclaimer, the term of this patent is extended or adjusted under 35 U.S.C. 154(b) by 0 days.

(21) Appl. No.: 16/483,901

(22) PCT Filed: Feb. 13, 2018

(86) PCT No.: PCT/JP2018/004941
§ 371 (c)(1),
(2) Date: Aug. 6, 2019

(87) PCT Pub. No.: WO2018/151115
PCT Pub. Date: Aug. 23, 2018

(65) Prior Publication Data

US 2019/0388951 A1 Dec. 26, 2019

(30) Foreign Application Priority Data

Feb. 14, 2017 (JP) ..... JP2017-024956
Feb. 14, 2017 (JP) ..... JP2017-024959

(51) Int. Cl.
*B21D 28/34* (2006.01)
*B26F 1/14* (2006.01)

(52) U.S. Cl.
CPC ..... *B21D 28/34* (2013.01); *B26F 1/14* (2013.01)

(58) Field of Classification Search
CPC ..... B21D 28/34; B26F 1/14
See application file for complete search history.

(56) References Cited

U.S. PATENT DOCUMENTS 1,754,568 A * 4/1930 Nischan ..... B21D 28/343 30/360
2,735,489 A 2/1956 Fowler
(Continued)

FOREIGN PATENT DOCUMENTS

CN 2066359 U 11/1990
CN 2146317 Y 11/1993
(Continued)

OTHER PUBLICATIONS

Office Action dated Jul. 29, 2020, issued in counterpart CN Application No. 201880010779.1, with English Translation. (14 pages).
(Continued)

*Primary Examiner* — Omar Flores Sanchez
(74) *Attorney, Agent, or Firm* — Westerman, Hattori, Daniels & Adrian, LLP

(57) ABSTRACT

A drilling jig for drilling a punching hole with a boundary between a basis material and a coating of a workpiece less noticeable, and a drilling method using this drilling jig. It includes a male blade, a female blade, and a hexagon bolt; the male blade and the hexagon bolt are capable of being coupled to each other; a screw hole, through which the hexagon bolt is inserted, and a blade portion are formed in the male blade; the blade portion has a planar blade surface; a shaft insertion hole, through which the hexagon bolt is inserted, and a blade portion housing hole capable of housing the blade portion are formed in the female blade, whereby the boundary between the basis material and the coating of a bumper can be positioned on the inside of the punching hole, preventing the appearance of the punching hole from being impaired.

15 Claims, 20 Drawing Sheets

(56) References Cited

U.S. PATENT DOCUMENTS

| | | | | |
|---|---|---|---|---|
| 4,594,779 | A * | 6/1986 | Hagemeyer | B21D 28/343 30/360 |
| 4,724,616 | A * | 2/1988 | Adleman | B26F 1/3846 30/360 |
| 7,587,830 | B2 * | 9/2009 | Nordlin | B21D 28/34 30/360 |
| 2009/0211327 | A1 | 8/2009 | Kanie | |

FOREIGN PATENT DOCUMENTS

| | | | |
|---|---|---|---|
| JP | 51-160289 | U | 12/1976 |
| JP | 61-108432 | A | 5/1986 |
| JP | 2009-202272 | A | 9/2009 |
| JP | 4969511 | B2 | 7/2012 |

OTHER PUBLICATIONS

International Search Report dated May 22, 2018, issued in counterpart International Application No. PCT/JP2018/004941, with English Translation. (3 pages).

* cited by examiner

DRILLING JIG AND DRILLING METHOD USING THIS DRILLING JIG

TECHNICAL FIELD

The present invention is related to a drilling jig for boring a punching hole in a resin member having a surface coated with coating such as a bumper of a vehicle, and a drilling method using the drilling jig.

BACKGROUND ART

There has been employed an ultrasonic sensing system in which when a vehicle approaches an obstacle around the vehicle during travel, an ultrasonic sensor attached to the bumper, etc., of the vehicle senses the approaching obstacle, and issues a warning alarm such as a buzzer sound to let a driver know the vehicle is approaching the obstacle. When installing such ultrasonic sensor to the bumper of a vehicle afterwards, it is necessary to bore a hole in the bumper to arrange a sensor microphone portion of the ultrasonic sensor in the bumper.

In that case, a hole has conventionally been drilled by cutting the bumper, using a rotatable tool such as a drill or hole saw. However, there has been a problem that due to the coating having already being applied to the bumper surface, use of such rotatable tool would cause the coating to be torn off by the rotational force of the rotatable tool, thereby severely impairing the appearance. Further, due to burrs being formed on the opening edge of the hole when such rotatable tools are used, it is necessary to cut such burrs, using a file or the like in order to remove them, thus posing a problem that a troublesome task is required therefor, and the coating is scraped off by such file or the like.

As another drilling method, which does not use the above-mentioned rotatable tool, there is disclosed a drilling tool for drilling a stepped hole in Patent document 1. The drilling tool is configured such that a resin substrate as a workpiece to be bored is sandwiched by a blade-receiving portion of a fixed mold and a blade portion of a movable mold, followed by punching out the workpiece.

Further, Patent document 2 discloses a press working method in which a bumper is punched out by a punch, and a burr produced on the upper surface of the bumper during the punching is crushed by the pressing surface of the punch.

PRIOR ART DOCUMENTS

Patent Documents

Patent document 1: JP Patent Publication No. 4969511

Patent document 2: JP Un-examined Patent Application Publication No. 2009-202272

SUMMARY OF THE INVENTION

Problems to be Solved by the Invention

The drilling tool described in Patent document 1 is a tool to bore a hole by so-called shear processing. The hole to be bored therein, however, is a stepped hole, and thus there occurs another deformation of shape in addition to the formation of a hole itself in a workpiece to be bored. Accordingly, when a coating is applied to the surface of the workpiece to be bored, there has been a risk that the coating may peel off in association with such deformation of shape. Moreover, it cannot be used for boring a non-stepped hole.

Further, according to the pressing method described in Patent document 2, the surface of the bumper produces a burr in a manner protruding upward, and such burr is then pressed downward to be collapsed, so that the edge of the opening of the bored hole is subjected to a load as a result of application of upward and downward forces. In a case where the surface of the bumper is coated with any coating material, such load may cause the cutting-off or peeling-off of the coating at an unintended position.

Accordingly, the present invention is aimed at solving the above problems, and providing a drilling jig and a drilling method using this drilling jig, which do not significantly destroy the appearance even when a coating has already been applied to a workpiece to be bored, by making the boundary between the basis material of the workpiece and the coating less noticeable at the opening edge of a punching hole.

A drilling jig set forth in a first aspect of the invention is configured to have a male blade, a female blade and a shaft member, in which the male blade and the shaft member are capable of being coupled to each other; the male blade has a blade portion formed therein; the blade portion has a planar blade surface; and the female blade has a blade portion housing hole formed therein, which is capable of housing the blade portion.

According to the drilling jig set forth in a second aspect of the invention, the male blade has a shaft coupling hole for inserting the shaft member thereinto and the blade portion, and the female blade has a shaft insertion hole for inserting the shaft member therethrough.

According to the drilling jig set forth in a third aspect of the invention, the male blade and the shaft member are capable of being coupled to each other, by inserting the shaft member into the shaft coupling hole such that a female screw portion formed in the male blade and a male screw portion formed in the shaft member are threadably engaged with each other.

According to the drilling jig set forth in a fourth aspect of the invention, the shaft member is a hexagon socket bolt, a hexagon bolt, or a hexagon socket bolt with a hexagonal column-shaped head portion, and the male blade has a tool latching portion for allowing a tool to be latched thereonto.

According to the drilling jig set forth in a fifth aspect of the invention, the shaft member has a guide portion that is capable of being inserted into the shaft insertion hole.

According to the drilling jig set forth in a sixth aspect of the invention, the shaft member has a shaft portion and a head portion that are attachable to and detachable from each other, and includes a rotation prevention member that regulates the rotation of the shaft portion inside the shaft insertion hole.

According to the drilling jig set forth in a seventh aspect of the invention, the female blade is provided with a biasing member that biases the female blade toward a direction departing away from a workpiece to be punched.

The method for drilling a punching hole set forth in an eighth aspect of the invention includes:

drilling a tentative hole in a workpiece for the shaft member to be inserted through the tentative hole, the workpiece being to be punched, and having a coating applied to one-side surface thereof;

inserting the shaft member, which has been inserted into the shaft insertion hole, into the tentative hole from an other side of the workpiece;

allowing the female blade to abut against the workpiece;

coupling the male blade and the shaft member to each other;

allowing the blade surface to abut against the one side of the workpiece;

sandwiching the workpiece by the male blade and the female blade;

allowing the male blade to come closer to the female blade by rotating the male blade about the shaft member with the shaft member being fixed so as not to be rotated, thereby cutting a part of the coating by the blade portion; and allowing the male blade and the female blade to come closer to each other by rotating the shaft member with the male member being fixed so as not to be rotated, thereby punching the workpiece.

The method for drilling a punching hole set forth in a ninth aspect of the invention includes:

drilling a tentative hole in a workpiece for the shaft portion to be inserted through the tentative hole, the workpiece being to be punched, and having a coating applied to one-side surface thereof;

inserting the shaft portion, which has been inserted into the shaft insertion hole, into the tentative hole from an other side of the workpiece;

allowing the female blade to abut against the workpiece;

coupling the male blade and the shaft portion to each other;

allowing the male blade to abut against the one side of the workpiece;

sandwiching the workpiece by the male blade and the female blade;

allowing the male blade to come closer to the female blade by rotating the male blade about the shaft portion with the shaft portion being fixed so as not to be rotated, thereby cutting a part of the coating by the blade portion; and allowing the male blade and the female blade to come closer to each other by rotating the head portion about the shaft portion with the male blade and the shaft portion being fixed so as not to be rotated, thereby punching the workpiece.

According to the method for drilling a punching hole set forth in a tenth aspect of the invention, the male blade has a male blade main body and a cylindrical portion, the male blade main body has the shaft coupling hole for inserting the shaft member therethrough, and the blade portion, the cylindrical portion has the shaft insertion hole for inserting the shaft member therethrough, and the female blade has a cylindrical portion insertion hole for inserting the cylindrical portion therethrough.

According to the method for drilling a punching hole set forth in an eleventh aspect of the invention, the male blade and the shaft member are capable of being coupled to each other, by inserting the shaft member into the shaft coupling hole to allow the female screw portion formed in the male blade and the male screw portion formed in the shaft member to threadably engage with each other.

According to the method for drilling a punching hole set forth in a twelfth aspect of the invention, the male blade main body has a tool latching portion for allowing a tool to be latched therein.

According to the method for drilling a punching hole set forth in a thirteenth aspect of the invention, the male blade main body has a cylindrical tool latching portion, and a concave latching hole is formed at one end of the tool latching portion in an axial direction thereof.

According to the method for drilling a punching hole set forth in a fourteenth aspect of the invention, a nut housing portion capable of housing a nut that threadably engages with the male screw portion is formed in the male blade.

According to the method for drilling a punching hole set forth in a fifteenth aspect of the invention, the blade portion is arranged between the cylindrical portion and the tool latching portion.

The method for drilling a punching hole set forth in a sixteenth aspect of the invention includes:

drilling a tentative hole in a workpiece for the shaft member to be inserted through the tentative hole, the workpiece being to be punched, and having a coating applied to one-side surface thereof;

inserting the shaft member, which has been inserted into a through-hole formed through the female blade, into the tentative hole from an other side of the workpiece;

inserting the cylindrical portion into the cylindrical portion insertion hole, while allowing the male blade to engage with the male screw portion of the shaft member;

allowing the blade surface to abut against the one-side surface of the workpiece;

sandwiching the workpiece by the male blade and the female blade;

allowing the male blade to come closer to the female blade by rotating the male blade about the shaft member with the shaft member being fixed so as not to be rotated, thereby cutting a part of the coating by the blade portion; and allowing the male blade and the female blade to come closer to each other by rotating the shaft member with the male blade being fixed so as not to be rotated, thereby punching the workpiece.

Effects of the Invention

According to the first aspect of the invention, it is possible to drill a punching hole in a workpiece.

According to the second aspect of the invention, it is possible to drill a punching hole in a workpiece after having cut a part of the coating on the workpiece that has the coating applied onto one-side surface thereof.

According to the third aspect of the invention, it is possible to allow the male blade and the shaft member to threadably engage with each other, enabling the moving distance of the male blade to be adjusted by the rotation of the male blade and the screw pitch thereof.

According to the fourth aspect of the invention, it is possible to fix or rotate the male blade and the shaft member by allowing a tool such as a spanner or a wrench to be latched thereonto.

According to the fifth aspect of the invention, the degree of rattling when inserting the shaft member through the female blade can be reduced.

According to the sixth aspect of the invention, the shaft member can be inserted through the shaft insertion hole from both directions of the female blade.

According to the seventh aspect of the invention, the drilling jig can be easily recovered after boring the punching hole.

According to the eighth aspect of the invention, it is possible to drill a punching hole with the boundary between the basis material of the bumper and the coating being made less noticeable at the opening edge portion of the punching hole.

According to the ninth aspect of the invention, it is possible to drill a punching hole with the boundary between the basis material of the workpiece and the coating being less noticeable at the opening edge portion of the punching hole.

According to the tenth aspect of the invention, it is possible to drill a punching hole through the workpiece, after cutting a part of the coating applied to the one-side surface of the workpiece.

According to the eleventh aspect of the invention, it is possible to allow the male blade and the shaft member to threadably engage with each other, enabling the moving distance of the male blade to be adjusted by the rotation of the male blade and the screw pitch thereof.

According to the twelfth aspect of the invention, it is possible to fix or rotate the male blade and the shaft member by allowing a tool such as a spanner or a wrench to be latched thereonto.

According to the thirteenth aspect of the invention, it is possible to fix or rotate the male blade by allowing a tool such as a hexagonal wrench to be latched into the latching hole.

According to the fourteenth aspect of the invention, it is possible to allow the male blade and the shaft member to be threadably engaged with each other, by housing the nut in the nut housing portion.

According to the fifteenth aspect of the invention, even when the male blade is inadvertently dropped, the blade portion is enabled to be less likely to hit the ground, thus enabling the blade portion to be prevented from being damaged.

According to the sixteenth aspect of the invention, it is possible to drill a punching hole with the boundary between the basis material of the workpiece and the coating being made less noticeable at the opening edge portion of the punching hole.

MODE FOR CARRYING OUT THE INVENTION

The embodiments of the present invention are described hereunder with reference to the accompanying FIG. 1 to FIG. 44. The embodiments described hereunder shall not limit the contents of the present invention that are described in the scope of claims. Further, not all the elements described hereunder are necessarily the essential elements of the present invention.

First Embodiment

Figure 1:
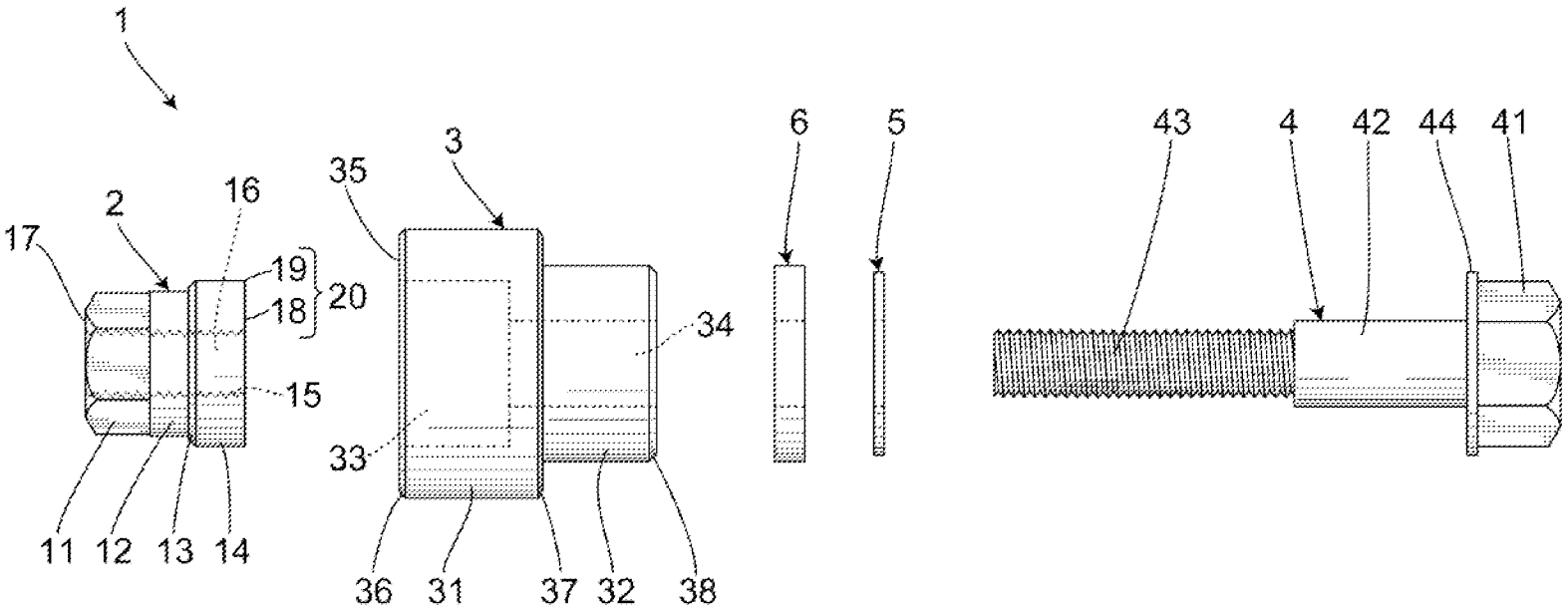
FIG. 1 is an exploded view illustrating a drilling jig according to a first embodiment of the present invention.
Figure 2:
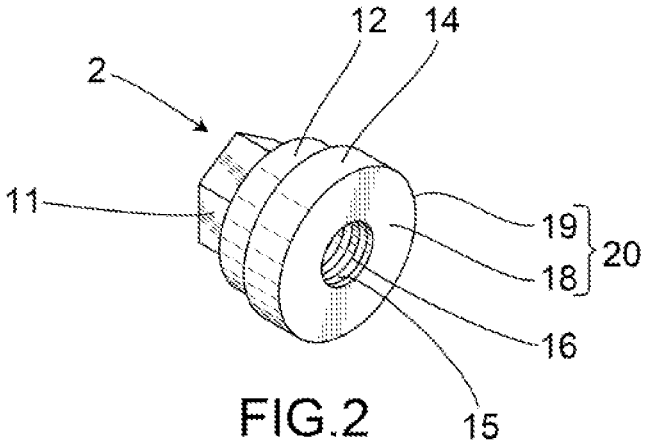
FIG. 2 is a perspective view of a male blade thereof.
Figure 3:
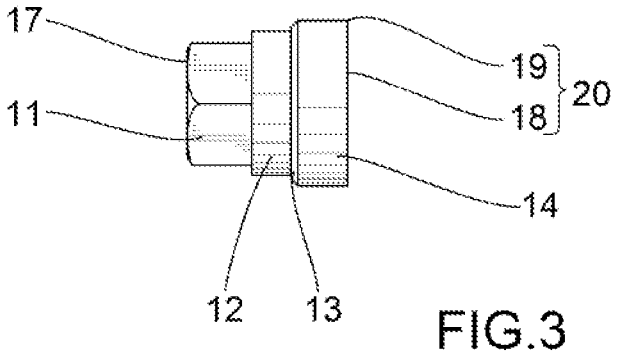
FIG. 3 is a plan view of the male blade thereof.
Figure 4:
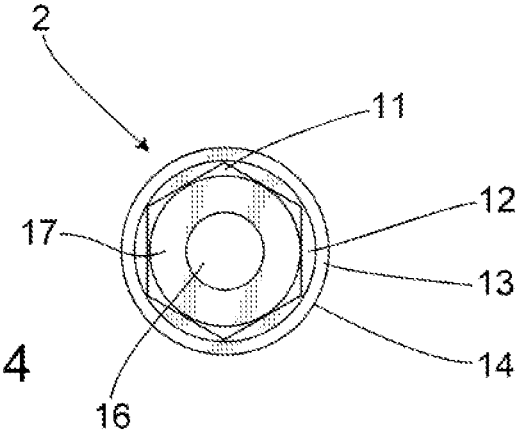
FIG. 4 is a left side view of the male blade thereof.
Figure 5:
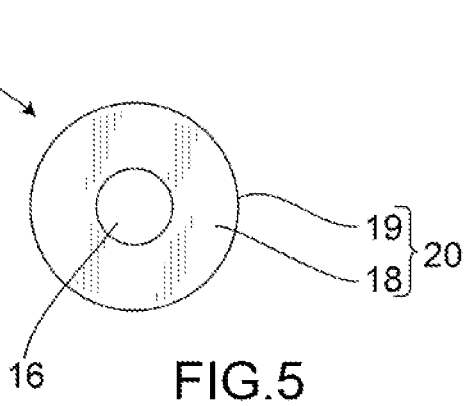
FIG. 5 is a right side view of the male blade thereof.
Figure 6:
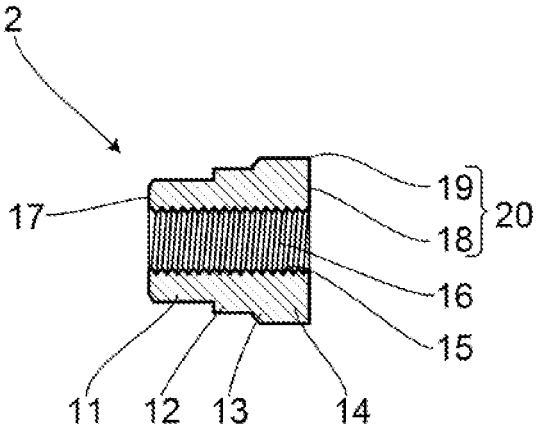
FIG. 6 is a vertical cross-sectional view of the male blade thereof.

As shown in FIG. 1, a drilling jig 1 of this embodiment includes a male blade 2, a female blade 3, a hexagon bolt 4 as a shaft member, a metal washer 5 and a resin washer 6. The male blade 2, female blade 3 and hexagon bolt 4 are made of a quenched steel.

As shown in FIG. 1 to FIG. 6, the male blade 2 includes a hexagonal column-shaped tool latching portion 11 allowing a tool such as a spanner or a wrench to be latched thereonto; an intermediate cylindrical portion 12 formed into a cylindrical shape having a diameter substantially identical to that of the tool latching portion 11; a tapered portion 13 gradually expanded in diameter from the intermediate cylindrical portion 12; and a blade forming portion 14 formed into a cylindrical shape having a diameter larger than that of the intermediate cylindrical portion 12. Although the tool latching portion 11 of this embodiment is formed into the shape of a hexagonal column, it may also, for example, be formed into other shapes corresponding to the tool to be used, such as the shape of a triangular column or a quadrangular column. Further, bored in the central portion of the male blade 2 with respect to the radial direction thereof is a screw hole 16 as a shaft coupling hole in which a female screw portion 15 is formed. The screw hole 16 is open to the outside at an end portion 17 of the tool latching portion 11. The female screw portion 15 can be screwed or threadably engaged with a male screw portion 43 formed on the hexagon bolt 4. A blade surface 18 as an end surface of the blade forming portion 14 formed into an annular shape is formed into a planar shape. This blade surface 18 and a blade corner portion 19 formed on the outer circumferential corner portion of the blade surface 18 serve as a blade portion 20.

Figure 7:
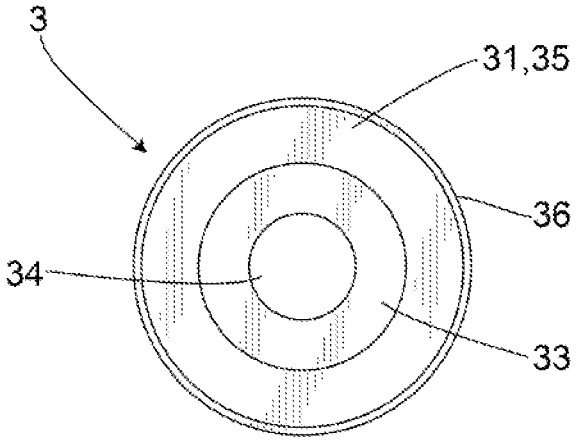
FIG. 7 is a left side view of a female blade thereof.
Figure 8:
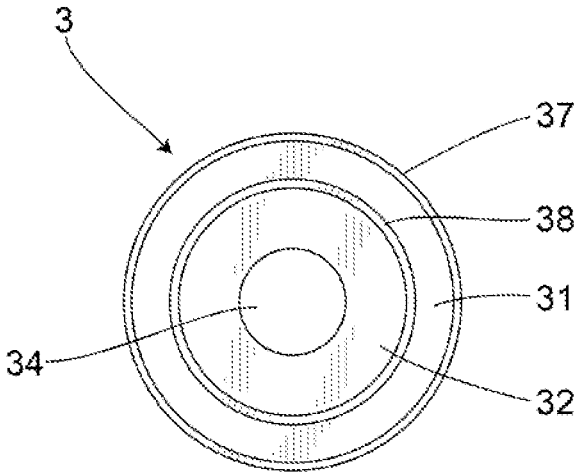
FIG. 8 is a right side view of the female blade thereof.

As shown in FIG. 1, FIG. 7 and FIG. 8, the female blade 3 includes a cylindrical housing portion 31; and a base portion 32 formed into a cylindrical shape having a diameter smaller than that of the housing portion 31. Bored in the housing portion 31 is a blade portion housing hole 33 having a diameter larger than the outer diameter of the blade forming portion 14 of the male blade 2. Further, bored in the housing portion 31 and the base portion 32 is a shaft insertion hole 34 through which a shank portion 42 and the male screw portion 43 of the hexagon bolt 4 can be inserted. The blade portion housing hole 33 and the shaft insertion hole 34 are communicated with each other. The diameter of the blade portion housing hole 33 is slightly larger than the outer diameter of the blade forming portion 14 so that the blade forming portion 14 can be inserted thereinto and removed therefrom. Further, the diameter of the shaft insertion hole 34 is slightly larger than the outer diameter of the shank portion 42 of the hexagon bolt 4 so that the shank portion 42 and the male screw portion 43 of the hexagon bolt 4 can be inserted thereinto and removed therefrom. An abutting surface 35 as an end surface opposite to the base portion 32 of the housing portion 31 is formed into a planar shape. Chamfered portions 36, 37 and 38 are respectively formed on the outer circumferential corner portion of the abutting surface 35, the outer circumferential corner portion of an end surface of the housing portion 31 that is opposite to the abutting surface 35, and the outer circumferential corner portion of an end surface of the base portion 32 that is opposite to the housing portion 31.

As shown in FIG. 1, the hexagon bolt 4 has a head portion 41 formed into the shape of a hexagonal column; the shank portion 42 formed into a cylindrical shape; and the male screw portion 43. The head portion 41 is provided with a flange 4. Further, the diameter of the shank portion 42 is formed slightly larger than the diameter of the male screw portion 43. Here, although the hexagon bolt 4 is used as the shaft member of this embodiment, a hexagon socket bolt (not shown) or a hexagon socket bolt with a hexagonal column-shaped head portion (not shown) may be used.

Figure 9:
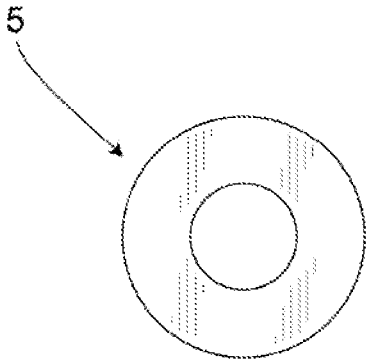
FIG. 9 is a left side view of a metal washer thereof.
Figure 10:
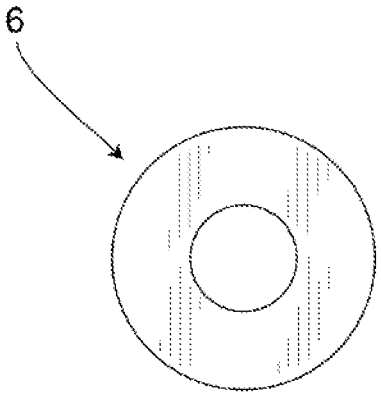
FIG. 10 is a left side view of a resin washer thereof.

As shown in FIG. 1, FIG. 9 and FIG. 10, each of the metal washer 5 and the resin washer 6 is formed into the shape of an annular plate. The outer diameter of the metal washer 5 is smaller than the outer diameter of the resin washer 6, but is substantially identical to the outer diameter of a flange portion 44 of the hexagon bolt 4. The outer diameter of the resin washer 6 is substantially identical to the outer diameter of the base portion 32 of the female blade 3.

Figure 11:
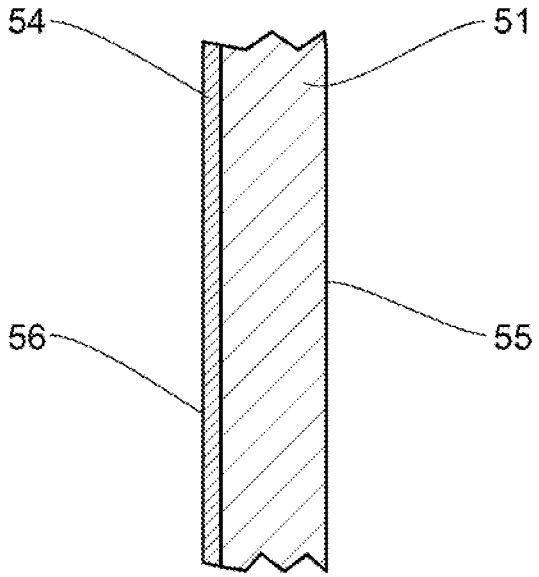
FIG. 11 is a cross-sectional view of a bumper thereof, with a coating applied thereto.
Figure 12:
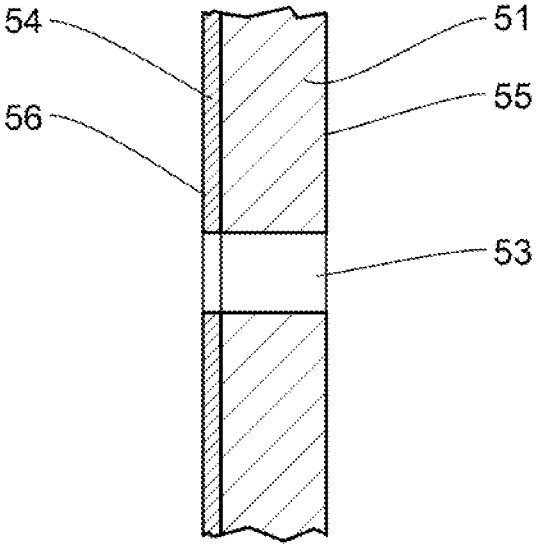
FIG. 12 is a cross-sectional view of the bumper thereof, with a tentative hole bored therein.
Figure 13:
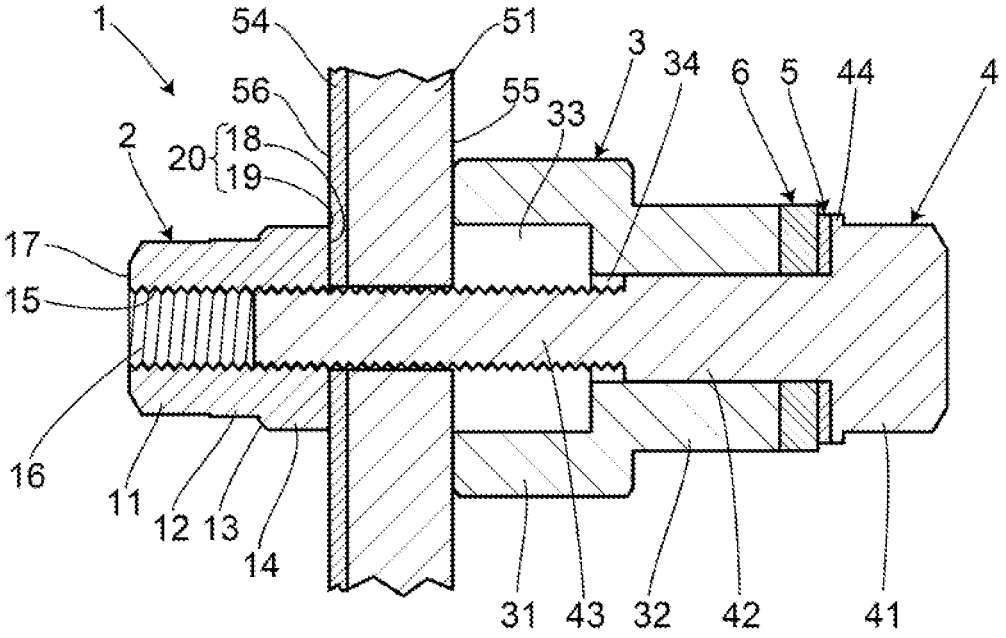
FIG. 13 is a cross-sectional view of a drilling jig and the bumper thereof, with the drilling jig being set on the bumper.

Here, described is a method for boring a punching hole 52 in a bumper 51 of a vehicle (not shown) as a workpiece to be bored, using the drilling jig 1. In the beginning, the setting of the drilling jig 1 will be described. First of all, a tool such as a drill (not shown) is used to bore in the bumper 51 a tentative hole 53 that is smaller than the punching hole 52 to be drilled eventually, and has a diameter through which the male screw portion 43 of the hexagon bolt 4 can be inserted. FIG. 11 shows the bumper 51 before the tentative hole 53 is drilled. FIG. 12 shows the bumper 51 in a state where the tentative hole 53 has been drilled. Next the hexagon bolt 4 is inserted through the metal washer 5 and the resin washer 6. At that time, the metal washer 5 is arranged on the head portion 41 side. Next, the hexagon bolt 4 is inserted from the base portion 32 side through the shaft insertion hole 34 and blade portion housing hole 33 of the female blade 3, and the metal washer 5 and the resin washer 6 will then be sandwiched between the female blade 3 and the flange portion 44 of the hexagon bolt 4. At that time, the hexagon bolt 4 is loosely inserted in the female blade 3, and the hexagon bolt 4 is thus rotatable in the blade portion housing hole 33 and shaft insertion hole 34 of the female blade 3. Next, the male screw portion 43 of the hexagon bolt 4 is inserted through the tentative hole 53 from a rear surface 55 side of the bumper 51, the rear surface 55 serving as a second surface of the bumper 51 and having no coating 54 thereon. In this way, the abutting surface 35 of the housing portion 31 will be brought into contact with and abut against the rear surface 55 of the bumper 51. In this state, the male blade 2 will be screwed to the male screw portion 43 of the hexagon bolt 4 protruding from a coated surface 56 side of the bumper 51, the coated surface 56 serving as a first surface of the bumper 51. By rotating the male blade 2 about the hexagon bolt 4 so as to bring the male blade 2 closer to the bumper 51 and then allow the blade surface 18 of the male blade 2 to abut against the coated surface 56 of the bumper 51, there will be established a state where the bumper 51 is sandwiched between the male blade 2 and the female blade 3, and the setting is thus completed. FIG. 13 shows a state where the setting has been completed. The male blade 2 and the hexagon bolt 4 can be threadably engaged with each other easily by rotating the male blade 2 while holding the hexagon bolt 4. However, they may also be screwed together by rotating the hexagon bolt 4 while holding the male blade 2, or rotating both the male blade 2 and the hexagon bolt 4. Also, an operator may directly rotate the male blade 2 and the hexagon bolt 4 by hand or using a tool such as a wrench or a spanner (not shown).

Figure 14:
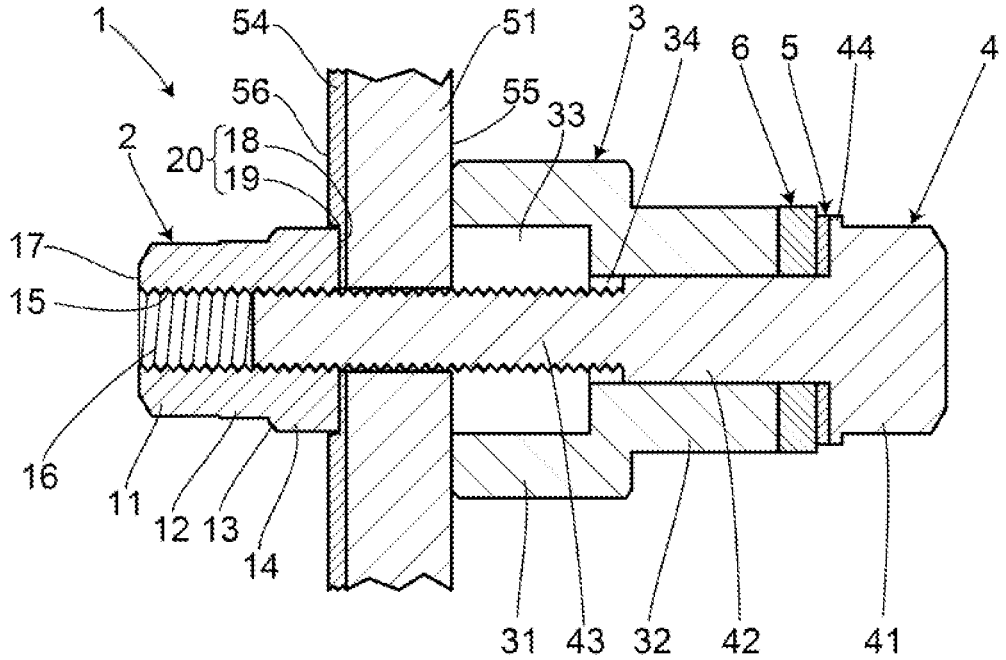
FIG. 14 is a cross-sectional view of the drilling jig and the bumper thereof, with a given amount of the coating having been cut.
Figure 15:
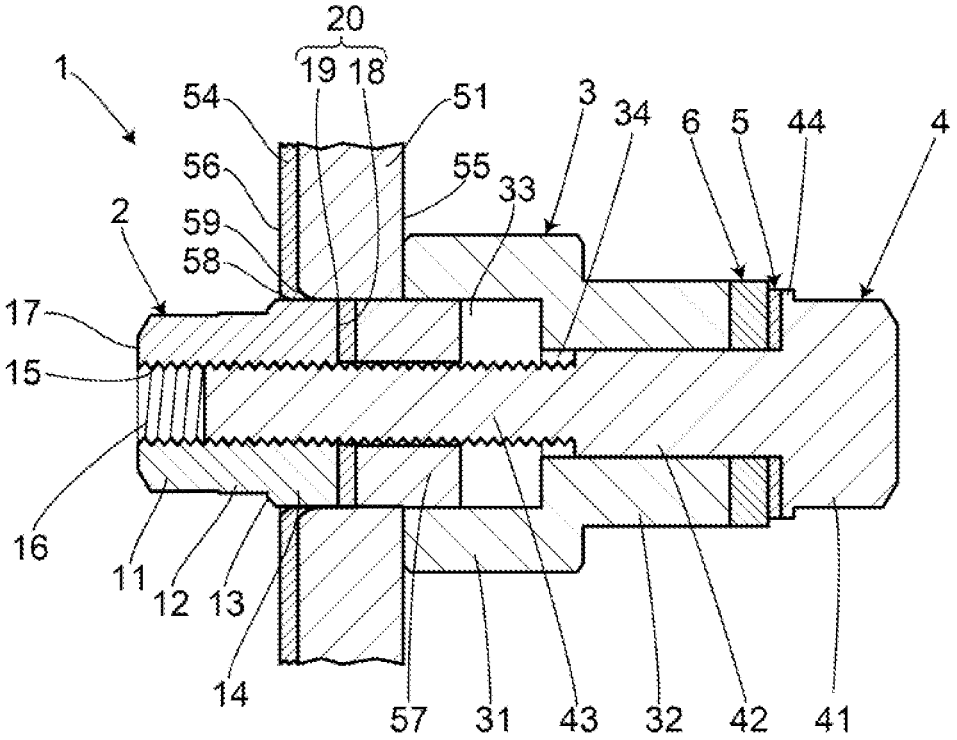
FIG. 15 is a cross-sectional view of the drilling jig and the bumper thereof, with the bumper being in the process of being punched out.
Figure 16:
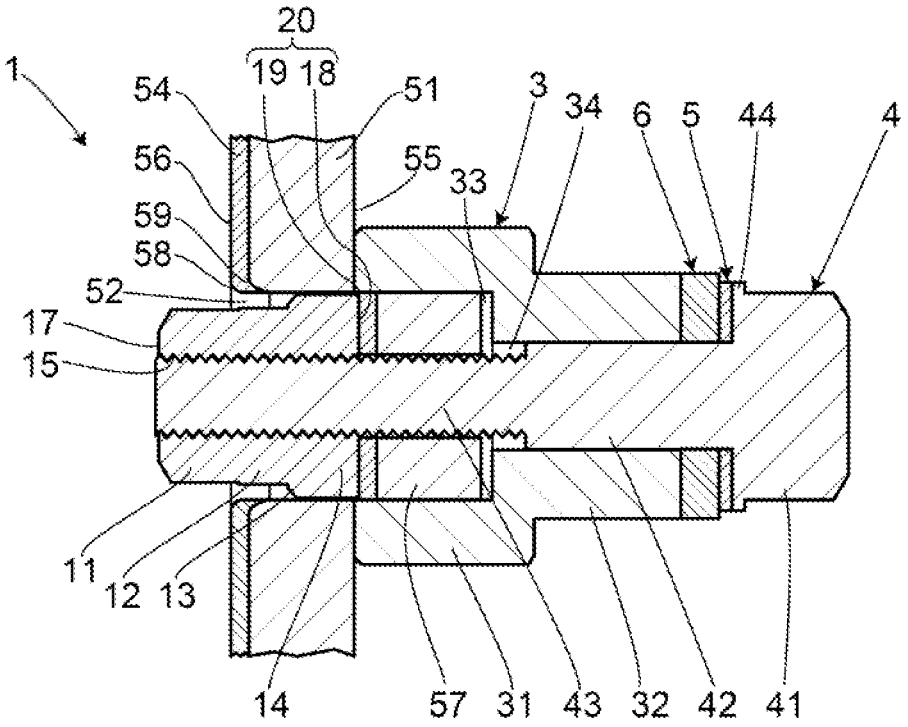
FIG. 16 is a cross-sectional view of the drilling jig and the bumper thereof, with the bumper having been punched out.

Next, described is a method for boring a punching hole 52 in the bumper 51 coated with the coating 54. Here, although the diameter of the punching hole 52 of this embodiment is about 2 cm, the diameter of the punching hole 52 can be any diameter by changing the diameter of the blade portion 20. In the beginning, with the hexagon bolt 4 being fixed so that it will not rotate, the male blade 2 will be rotated about the hexagon bolt 4 to be brought closer to the female blade 3. At that time, the coating 54 on the bumper 51 that is in close contact with the blade portion 20 of the male blade 2 will be cut by a given amount. Then, the rotation of the male blade 2 will be stopped, and the male blade 2 itself will thus be fixed, leaving a given thickness of the coating 54. FIG. 14 shows a state where the coating 54 has been cut off by a given amount, and the rotation of the male blade 2 has been stopped. Next, with the male blade 2 being fixed so that it will not rotate, the hexagon bolt 4 will be rotated to screw the male screw portion 43 of the hexagon bolt 4 into the female screw portion 15 of the male blade 2. At that time, the blade portion 20 of the male blade 2 and the abutting surface 35 of the female blade 3 are to be pressed against the bumper 51 more strongly. Here, the reason that the male blade 2 is to be fixed so that it will not rotate is because there is a need to prevent the coating 54 from being cut more than necessary. By further rotating the hexagon bolt 4, a shear force acting on the bumper 51 will become greater than a shear strength of the bumper 51, thereby causing the bumper 51 to be punched out by the male blade 2. In this way, the drilling of the punching hole 52 using the drilling jig 1 is a so-called shearing process where the male blade 2 serves as a punch, and the female blade 3 serves as a die. When the bumper 51 has been punched out, the blade portion 20 of the male blade 2 and fragments 57 of the punched bumper 51 are to be received in the blade portion housing hole 33 of the female blade 3. FIG. 15 shows a state where the bumper 51 is being punched out; FIG. 16 shows a state where the bumper 51 has been punched out, and the blade portion 20 as well as the fragments 57 are now received in the blade portion housing hole 33. In the end, the male blade 2 is rotated about the hexagon bolt 4 so as to be moved away from the female blade 3 and then removed from the hexagon bolt 4. The hexagon bolt 4 is then pulled out from the punching hole 52, and the fragments 57 are then taken out from the blade portion housing hole 33, thereby establishing a state where the punching hole 52 is bored in the bumper 51.

In the above method for drilling the punching hole 52, by cutting the coating 54 in a way such that a given amount thereof will be left, the remaining coating 54 when the bumper 51 has been punched out and the basis material of the bumper 51 will be pulled toward the inner side of the punching hole 52 such that an opening corner portion 58 of the coating 54 and an opening corner portion 59 of the bumper 51 will turn into curved shapes. In this way, the opening corner portion 59 of the bumper 51 will be covered by the coating 54 so that no burrs will occur on an opening edge portion of the punching hole 52, thereby resulting in a well-finished condition. Further, since a boundary between the coating 54 and the basis material of the bumper 51 is located inside the punching hole 52, the boundary between the basis material of the bumper 51 and the coating 54 cannot be seen easily when viewed from the outer side of the bumper 51, thus preventing the exterior appearance from being impaired due to the drilling of the punching hole 52. In this embodiment, the thickness of the bumper 51 is 3 mm; the thickness of the coating 54 is 0.050 to 0.052 mm; the screw pitch of the male screw portion 43 of the hexagon bolt 4 is 1.25 mm; and the male blade 2 is rotated about 180° when cutting the coating 54. When the thickness of the coating 54 and/or the screw pitch are changed, the amount by which the male blade 2 is rotated may simply be determined so as to be able to leave a given amount of the coating 54.

The drilling jig 1 of this embodiment may also be used to bore the punching hole 52 in a bumper 51 that is not coated with the coating 54. The bumper 51 is made of a synthetic resin such as polypropylene (PP) or polycarbonate (PC). If the punching hole 52 is to be bored in such bumper 51 by a normal shearing technique, distortion will occur at, for example, the opening corner portion 59 of the bumper 51 due to the shear force, and the deformed area(s) will turn white to impair the exterior appearance. Therefore, the surface side of the bumper 51 will be cut by a given amount, by rotating the male blade 2 by a given amount e.g. 360° while keeping the hexagon bolt 4 fixed so that the hexagon bolt 4 will not rotate. Later, the hexagon bolt 4 is rotated while keeping the male blade 2 fixed so that the male blade 2 will not rotate, thereby allowing the male blade 2 to punch out the bumper 51 to form the punching hole 52. Unlike the above case employing the bumper 51 coated with the coating 54, the opening corner portion 59 of the bumper 51 in this case will not turn into a curved shape.

Described hereunder is a method for boring the punching hole 52 in a bumper 51 that is made of a mixture material of polycarbonate (PC) and acrylonitrile styrene acrylate (ASA), and is not coated with the coating 54. The bumper 51 made of the mixture material of PC and ASA has a high hardness, and it is difficult to cut the surface thereof with the male blade 2. Therefore, with the male blade 2 being fixed so that it will not rotate, the hexagon bolt 4 is then rotated to allow the male blade 2 to punch out the bumper 51. The opening corner portion 59 of the bumper 51 will turn into a curved shape, because the opening corner portion 59 is to be pulled toward the inner side of the punching hole 52.

As described above, the drilling jig 1 of this embodiment includes the male blade 2, the female blade 3 and the hexagon bolt 4 as the shaft member. The male blade 2 and the hexagon bolt 4 can be coupled together. The blade portion 20 is formed on the male blade 2, and the blade portion 20 has the planar-shaped blade surface 18. Formed on the female blade 3 is the blade portion housing hole 33 capable of receiving the blade portion 20. In this way, the bumper 51 can be sandwiched between the male blade 2 and the female blade 3, and the male blade 2 can then punch out the bumper 51 so as to form the punching hole 52.

Further, in the case of the drilling jig 1 of this embodiment, formed on the male blade 2 is the screw hole 16 as the shaft coupling hole through which the hexagon bolt 4 is to be inserted. Formed on the female blade 3 is the shaft insertion hole 34 through which the hexagon bolt 4 is to be inserted. In this way, after allowing the male blade 2 to uniformly cut the coating 54 applied to the bumper 51, the male blade 2 can then punch out the bumper 51 to form the punching hole 52. Further, since the coating 54 on the opening corner portion 58 of the punching hole 52 is to be pulled toward the inner side of the punching hole 52, the boundary between the basis material of the bumper 51 and the coating 54 is hardly visible from the outside.

Further, in the case of the drilling jig 1 of this embodiment, the male blade 2 and the hexagon bolt 4 are to be coupled together by inserting the hexagon bolt 4 through the screw hole 16, and then screwing together the female screw portion 15 formed on the male blade 2 and the male screw portion 43 formed on the hexagon bolt 4. In this way, the male blade 2 can be moved by being rotated about the hexagon bolt 4. In addition, Further, the moving distance of the male blade 2 can be adjusted by the amount of rotation of the male blade 2 and the screw pitch.

Further, in the case of the drilling jig 1 of this embodiment, the hexagon bolt 4 is a hexagon socket bolt, a hexagon bolt or a hexagon socket bolt with a hexagonal column-shaped head portion. The male blade 2 is provided with the tool latching portion 11 allowing a tool to be latched thereonto. In this way, a spanner or a wrench can be latched onto the male blade 2 and the hexagon bolt 4 to fix or rotate the male blade 2 and the hexagon bolt 4.

In addition, according to the drilling method of this embodiment, the tentative hole 53 through which the hexagon bolt 4 is to be inserted will be bored in the bumper 51 with the coating 54 being applied to form the coated surface 56. The hexagon bolt 4 inserted through the shaft insertion hole 34 is then inserted through the tentative hole 53 from the rear surface 55 side of the bumper 51, in a way such that the female blade 3 will eventually be brought into contact with and abut against the bumper 51. Next, the male blade 2 will be coupled to the hexagon bolt 4 in a way such that the blade surface 18 will eventually be brought into contact with and abut against the coated surface 56 of the bumper 51. There, with the bumper 51 being sandwiched between the male blade 2 and the female blade 3, the male blade 2 is then brought closer to the female blade 3 by being rotated about the hexagon bolt 4 while keeping the hexagon bolt 4 fixed so that the hexagon bolt 4 itself will not rotate. The blade portion 20 will thus cut a part of the coating 54, and the male blade 2 and female blade 3 will then be brought even closer to each other by rotating the hexagon bolt 4 while keeping the male blade 2 fixed so that the male blade 2 itself will not rotate. In this way, the bumper 51 will be punched out, and the coating 54 applied to the bumper 51 will be cut by the male blade 2 i.e. the punching hole 52 is thus formed by allowing the male blade 2 to punch out the bumper 51. Further, since the coating 54 on the opening corner portion 58 of the punching hole 52 will be pulled toward the inner side of the punching hole 52, the boundary between the basis material of the bumper 51 and the coating 54 becomes hardly visible from the outside, thus preventing the exterior appearance of the bumper 51 from being impaired due to the drilling of the punching hole 52. Moreover, the moving distance of the male blade 2 can be adjusted by the screw pitches of the female screw portion 15 and male screw portion 43 as well as the amount of rotation of the male blade 2; and the amount of the coating 54 to be cut by the male blade 2 can also be determined by the screw pitches of the female screw portion 15 and male screw portion 43 as well as the amount of rotation of the male blade 2.

Second Embodiment

Figure 17:
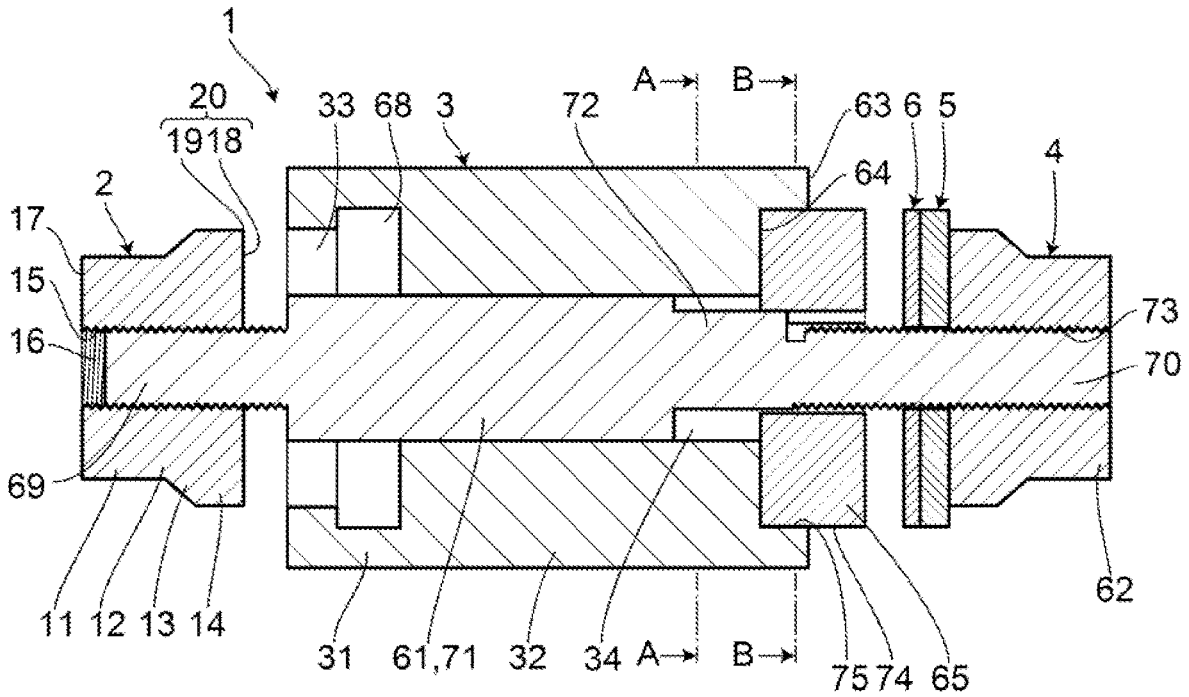
FIG. 17 is a vertical cross-sectional view of a drilling jig according to a second embodiment of the present invention.
Figure 18:
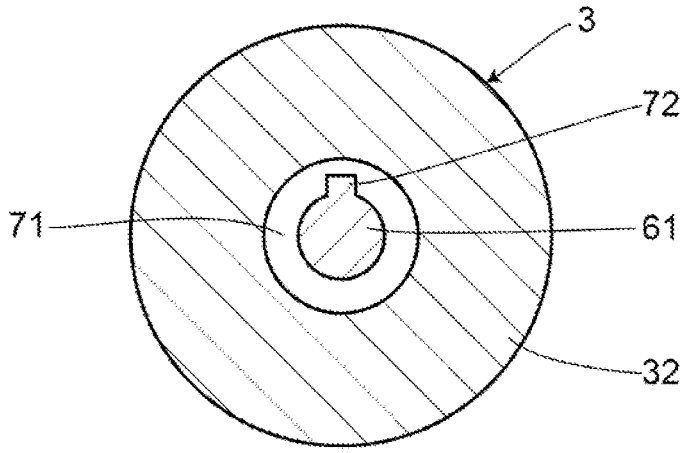
FIG. 18 is a cross-sectional view of the drilling jig thereof, taken along A-A line.
Figure 19:
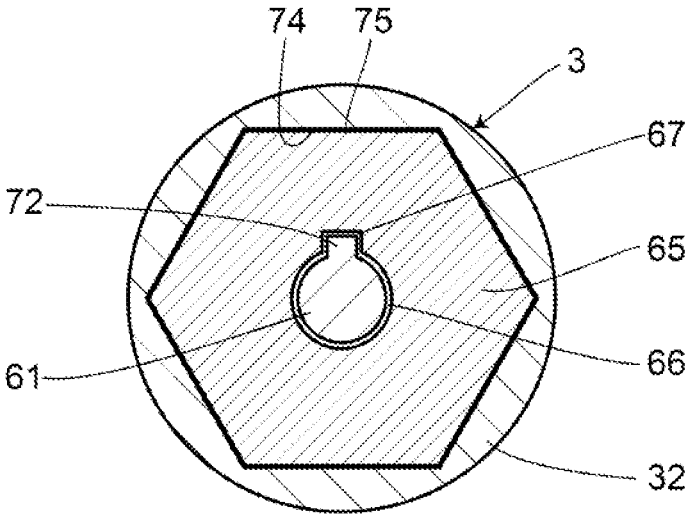
FIG. 19 is a cross-sectional view of the drilling jig thereof, taken along B-B line.

FIG. 17 to FIG. 19 show a second embodiment of the present invention. Elements identical to those in the first embodiment are given identical symbols, and the detailed descriptions thereof are thus omitted. In the case of the drilling jig 1 of this embodiment, the hexagon bolt 4 is composed of two parts which are a shaft portion 61 and a head portion 62.

As for the female blade 3 of this embodiment, the outer diameters of the housing portion 31 and the base portion 32 are identical to each other. A hexagonal groove 64 having a hexagonal opening is formed at an end portion 63 of the base portion 32 that is opposite to the housing portion 31. This hexagonal groove 64 is configured in a way such that a part of a hexagonal plate-shaped anti-rotation member 65 can be inserted and locked thereinto. As shown in FIG. 19, the anti-rotation member 65 is provided with a circular hole 66 through which the shaft portion 61 can be inserted; and a rectangular hole 67 through which a later-described anti-rotation rib 72 can be inserted, the circular hole 66 and the rectangular hole 67 being communicated with each other. Further, bored in the housing portion 31 are the blade portion housing hole 33 as well as a fragment housing hole 68 capable of storing the fragments that have occurred upon punching out the bumper 51. The diameter of the fragment housing hole 68 is larger than the diameter of the blade portion housing hole 33.

Formed on one end side of the shaft portion 61 of the hexagon bolt 4 is a male-blade screw portion 69 allowing the male blade 2 to be screwed thereto; and formed on the other end side of the shaft portion 61 of the hexagon bolt 4 is a head-portion screw portion 70 allowing the head portion 62 to be screwed thereto. The diameters of the male-blade screw portion 69 and the head-portion screw portion 70 are substantially identical to each other. A cylindrical guiding portion 71 is formed between the male-blade screw portion 69 and the head-portion screw portion 70. The guiding portion 71 is larger in diameter than the male-blade screw portion 69 and the head-portion screw portion 70. The shaft portion 61 is not formed into a full thread bolt, but is provided with the guiding portion 71. Thus, the male-blade screw portion 69 and the head-portion screw portion 70 as screw portions are formed shorter, which makes it possible to restrict distortions in the male-blade screw portion 69 and head-portion screw portion 70 that are observed after performing quenching. Further the outer diameter of the guiding portion 71 is designed to be slightly smaller than the diameter of the shaft insertion hole 34 of the female blade 3 such that the degree of rattling when inserting the guiding portion 71 through the shaft insertion hole 34 can be minimized. In this way, the blade surface 18 of the male blade 2 and the abutting surface 35 of the female blade 3 can be arranged more parallel to each other with the drilling jig 1 being set. Formed between the head-portion screw portion 70 and the guiding portion 71 is an anti-rotation rib 72 protruding outward in the radial direction of the shaft portion 61 and substantially exhibiting a rectangular shape in a cross-sectional view. The anti-rotation rib 72 is formed slightly smaller than the rectangular hole 67. Once the shaft portion 61 has been rotated with the anti-rotation rib 72 being inserted through the rectangular hole 67, an outer portion 76 of the anti-rotation rib 72 will be immediately latched onto an inner portion 77 of the rectangular hole 67.

A shaft portion screw hole 73 is bored in a central portion of the head portion 62 with respect to the radial direction thereof. The shaft portion 61 and the head portion 62 can be coupled together by screwing the head-portion screw portion 70 of the shaft portion 61 to the shaft portion screw hole 73. Both ends of the head portion 62 in the axial direction are opened via the shaft portion screw hole 73.

Here, a method for setting the drilling jig 1 of this embodiment will be described. In the beginning, the anti-rotation member 65 is to be inserted into the hexagonal groove 64, and the guiding portion 71 of the shaft portion 61 is to be inserted into the shaft insertion hole 34 of the female blade 3. At that time, the anti-rotation rib 72 will be inserted though the rectangular hole 67 of the anti-rotation member 65. Next, the head-portion screw portion 70 is to be inserted through the metal washer 5 and the resin washer 6, followed by screwing the head portion 62 to the head-portion screw portion 70. There, the metal washer 5 is to be arranged on the head portion 62 side. Next, the male-blade screw portion 69 of the shaft portion 61 will be inserted through the tentative hole 53 from the rear surface 55 side of the bumper 51, and the abutting surface 35 of the female blade 3 will then be brought into close contact with the rear surface 55. In the end, the male blade 2 will be screwed to the male-blade screw portion 69; and once the blade surface 18 has come into close contact with the coated surface 56 of the bumper 51, setting will thus be completed. When screwing the male blade 2 and the head portion 62, an operator may directly rotate them by hand or using a tool such as a wrench or a spanner (not shown).

The drilling jig 1 is designed in a fashion such that in a state where the anti-rotation member 65 is received in the hexagonal groove 64, an outer circumferential portion 74 of the anti-rotation member 65 is thus latched onto an inner circumferential portion 75 of the hexagonal groove 64 so that the anti-rotation member 65 will not rotate in the hexagonal groove 64. Further, the outer portion 76 of the anti-rotation rib 72 will be latched onto an inner portion 77 of the hexagonal groove 64 by allowing the anti-rotation rib 72 formed on the shaft portion 61 to be inserted through the rectangular hole 67 formed on the anti-rotation member 65, thereby restricting the rotation of the shaft portion 61. Thus, when the drilling jig 1 is already set in the above manner, the shaft portion 61 will not rotate in the blade portion housing hole 33, shaft insertion hole 34 and fragment housing hole 68 of the female blade 3.

Next, described is a method for boring the punching hole 52 in the bumper 51 coated with the coating 54, using the drilling jig 1 of this embodiment. Here, although the diameter of the punching hole 52 of this embodiment is about 2 cm, the diameter of the punching hole 52 can be any diameter by changing the diameter of the blade portion 20. In the beginning, the male blade 2 is rotated about the shaft portion 61 so as to be brought closer to the female blade 3. At that time, the female blade 3 is kept fixed so that the female blade 3, the hexagon bolt 4 and the anti-rotation member 65 will not rotate together. With the blade portion 20 of the male blade 2 abutting against the bumper 51, the rotation of the male blade 2 will cause a given amount of the coating 54 to be cut. Then, the rotation of the male blade 2 will be stopped, and the male blade 2 itself will thus be fixed, leaving a given thickness of the coating 54. Next, with the male blade 2 being fixed so that it will not rotate, the head portion 62 will be rotated about the shaft portion 61 so as to be brought closer to the male blade 2. There, the female blade 3 will be pushed by the head portion 62 such that the blade portion 20 of the male blade 2 and the abutting surface 35 of the female blade 3 will be pushed against the bumper 51 more strongly. By further rotating the head portion 62, a shear force acting on the bumper 51 will become greater than the shear strength of the bumper 51, thereby causing the bumper 51 to be punched out by the male blade 2. Once the bumper 51 has been punched out, the blade portion 20 of the male blade 2 will be received in the blade portion housing hole 33, and the fragments 57 that have occurred upon punching out the bumper 51 will be received in either the blade portion housing hole 33 or the fragment housing hole 68. In the end, the male blade 2 will be rotated so as to be moved away from the female blade 3, and then pulled out of the female blade 3 as well as the punching hole 52 before being unscrewed from the male-blade screw portion 69, thus leaving the bumper 51 with the punching hole 52 already being bored therein. The fragments 57 of the bumper 51 may then simply be taken out of the female blade 3 and then discarded.

As described above, in the case of the drilling jig 1 of this embodiment, the hexagon bolt 4 has the guiding portion 71, and the guiding portion 71 can be inserted through the shaft insertion hole 34. In this way, the length of the male screw portion 43 of the hexagon bolt 4 can be minimized such that distortion in the hexagon bolt 4 due to quenching can be restricted. Further, the degree of rattling when inserting the guiding portion 71 through the shaft insertion hole 34 can be minimized.

In addition, in the case of the drilling jig 1 of this embodiment, the hexagon bolt 4 has the detachable shaft portion 61 and head portion 62, and there is provided the anti-rotation member 65 for preventing the shaft portion 61 from rotating in the shaft insertion hole 34. Thus, when inserting the shaft portion 61 through the shaft insertion hole 34, the shaft portion 61 may actually be inserted from both directions. Further, when replacing the shaft portion 61 and the head portion 62, each of them can be replaced individually. Furthermore, due to the anti-rotation member 65, the head portion 62 can be rotated about the shaft portion 61 without rotating the shaft portion 61.

In addition, in the case of the drilling jig 1 of this embodiment, the tentative hole 53 through which the shaft portion 61 is to be inserted will be bored in the bumper 51 with the coating 54 being applied to form the coated surface 56. The shaft portion 61 inserted through the shaft insertion hole 34 is then inserted through the tentative hole 53 from the rear surface 55 side of the bumper 51, in a way such that the female blade 3 will eventually be brought into contact with and abut against the bumper 51. Next, the male blade 2 will be coupled to the shaft portion 61 in a way such that the male blade 2 will eventually be brought into contact with and abut against the coated surface 56 of the bumper 51. There, with the bumper 51 being sandwiched between the male blade 2 and the female blade 3, the male blade 2 is then brought closer to the female blade 3 by being rotated about the shaft portion 61 while keeping the shaft portion 61 fixed so that the shaft portion 61 itself will not rotate. The blade portion 20 will thus cut a part of the coating 54, and the male blade 2 and female blade 3 will then be brought even closer to each other by rotating the head portion 62 about the shaft portion 61 while keeping the male blade 2 and the shaft portion 61 fixed so that they will not rotate. In this way, the bumper 51 will be punched out, and the coating 54 applied to the bumper 51 will be cut by the male blade 2 i.e. the punching hole 52 is thus formed by allowing the male blade 2 to punch out the bumper 51. Further, since the coating 54 on the opening edge portion of the punching hole 52 will be pulled toward the inner side of the punching hole 52, the boundary between the basis material of the bumper 51 and the coating 54 becomes hardly visible from the outside, thus preventing the exterior appearance of the bumper 51 from being impaired due to the drilling of the punching hole 52. Moreover, the moving distance of the male blade 2 can be adjusted by the screw pitches of the female screw portion 15 and male screw portion 43 as well as the amount of rotation of the male blade 2; and the amount of the coating 54 to be cut by the male blade 2 can also be determined by the screw pitches of the female screw portion 15 and male screw portion 43 as well as the amount of rotation of the male blade 2. Moreover, the punching hole 52 can be bored by rotating the head portion 62.

Third Embodiment

Figure 20:
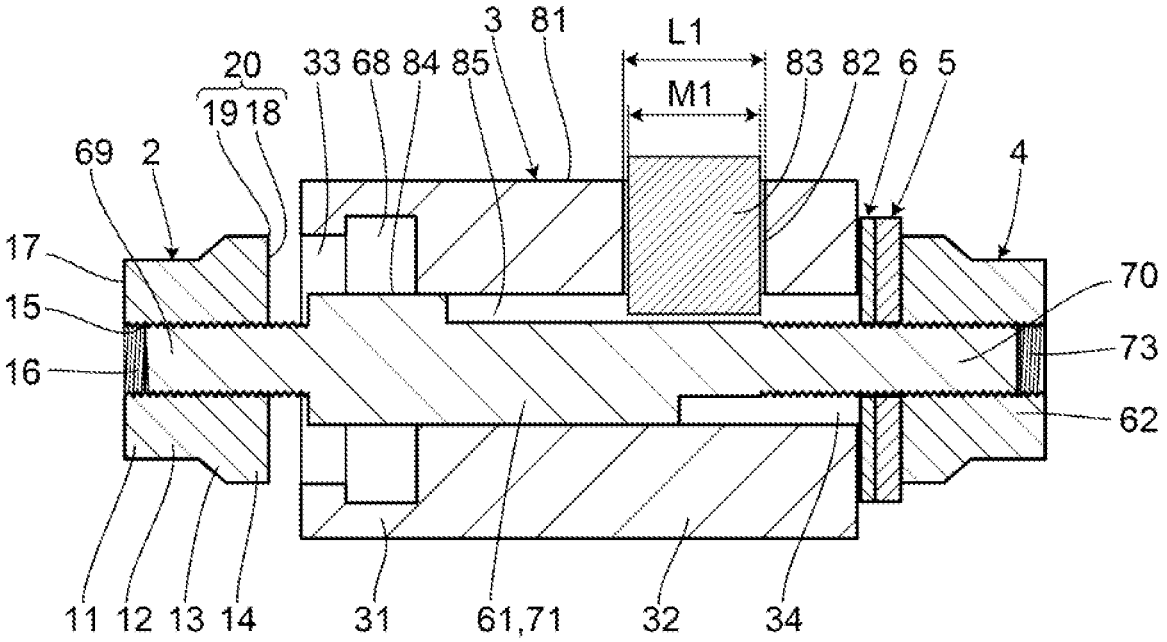
FIG. 20 is a vertical cross-sectional view of a drilling jig according to a third embodiment of the present invention.
Figure 21:
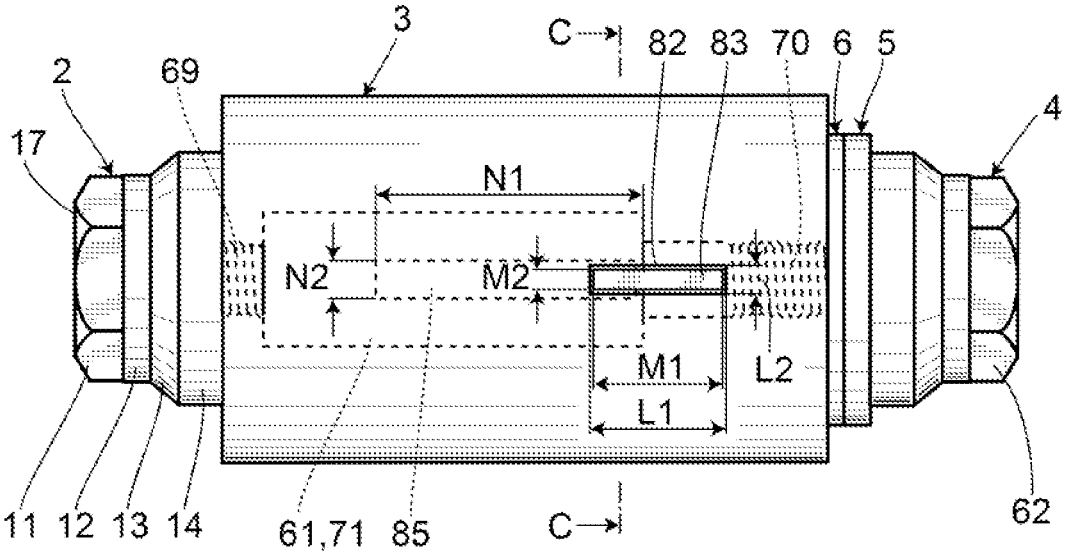
FIG. 21 is a partially see-through perspective view of the drilling jig thereof.
Figure 22:
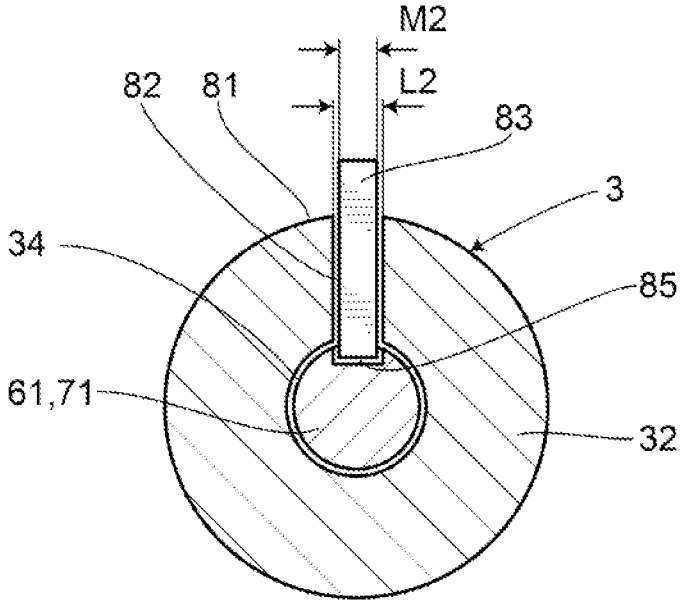
FIG. 22 is a cross-sectional view of the drilling jig thereof, taken along C-C line.

FIG. 20 to FIG. 22 show a third embodiment of the present invention. Elements identical to those in the first and second embodiments are given identical symbols, and the detailed descriptions thereof are thus omitted. As for the drilling jig 1 of this embodiment, the hexagon bolt 4 is composed of two parts which are the shaft portion 61 and the head portion 62, as is the case in the second embodiment.

Although the female blade 3 in this embodiment is not provided with the hexagonal groove 64 of the second embodiment, a rectangular prevention plate insertion hole 82 is bored in a side portion 81 of the female blade 3. A rectangular plate-shaped rotation prevention plate 83 as an anti-rotation member can be inserted into such prevention plate insertion hole 82. A length L1 of an opening of the prevention plate insertion hole 82 in a longitudinal direction is formed slightly larger than a length M1 of the rotation prevention plate 83 in the longitudinal direction, and a length L2 of the opening of the prevention plate insertion hole 82 in a transverse direction is formed slightly larger than a length M2 of the rotation prevention plate 83 in the transverse direction. In this way, the rotation prevention plate 83 can hardly move in the prevention plate insertion hole 82.

An elongated rectangular narrow groove 85 is formed on a side surface portion 84 of the guiding portion 71 of the shaft portion 61. A length N1 of the narrow groove 85 in the longitudinal direction is formed sufficiently longer than the length M1 of the rotation prevention plate 83 in the longitudinal direction. Thus, the shaft portion 61 can move axially in the shaft insertion hole 34 even with the rotation prevention plate 83 being inserted into the narrow groove 85. Further, a length N2 of the narrow groove 85 in the transverse direction is formed slightly larger than the length M2 of the rotation prevention plate 83 in the transverse direction. Thus, the rotation prevention plate 83 can hardly move along the transverse direction in the narrow groove 85. The length L2 of the opening of the prevention plate insertion hole 82 in the transverse direction is substantially identical to the length N2 of the narrow groove 85 in the transverse direction.

Here, the setting of the drilling jig 1 of this embodiment will be described. In the beginning, the guiding portion 71 of the shaft portion 61 is to be inserted through the shaft insertion hole 34 of the female blade 3. Next, the head-portion screw portion 70 will be inserted through the metal washer 5 and the resin washer 6, and the head portion 62 will then be screwed to the head-portion screw portion 70. At that time, the metal washer 5 is to be arranged on the head portion 62 side. Next, the shaft portion 61 will be rotated in the shaft insertion hole 34 to align the prevention plate insertion hole 82 with the narrow groove 85, followed by inserting the rotation prevention plate 83 through the prevention plate insertion hole 82 and then into the narrow groove 85. Next, the male-blade screw portion 69 of the shaft portion 61 will be inserted through the tentative hole 53 from the rear surface 55 side of the bumper 51, and the abutting surface 35 of the female blade 3 will thus be brought into close contact with the rear surface 55. In the end, the male blade 2 will be screwed to the male-blade screw portion 69; and once the blade surface 18 has come into close contact with the coated surface 56 of the bumper 51, setting will thus be completed. When screwing the male blade 2 and the head portion 62, an operator may directly rotate them by hand or using a tool such as a wrench or a spanner (not shown). A method for boring the punching hole 52 in the bumper 51 coated with the coating 54, using the drilling jig 1 of this embodiment, is similar to that of the second embodiment; the description of this method is thus omitted.

As described above, in the case of the drilling jig 1 of this embodiment, the hexagon bolt 4 has the detachable shaft portion 61 and head portion 62, and there is provided the rotation prevention plate 83 for preventing the shaft portion 61 from rotating in the shaft insertion hole 34. Thus, when inserting the shaft portion 61 through the shaft insertion hole 34, the shaft portion 61 may actually be inserted from both directions. Further, when replacing the shaft portion 61 and the head portion 62, each of them can be replaced individually. Furthermore, due to the rotation prevention plate 83, the head portion 62 can be rotated about the shaft portion 61 without rotating the shaft portion 61.

Fourth Embodiment

Figure 23:
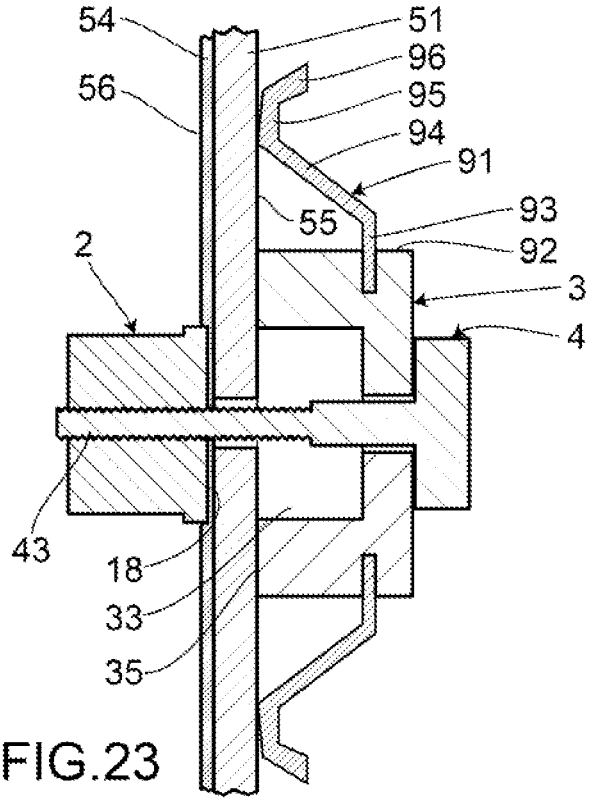
FIG. 23 is a cross-sectional view of a drilling jig and the bumper, with a given amount of the coating having been cut, according to a fourth embodiment of the present invention.
Figure 24:
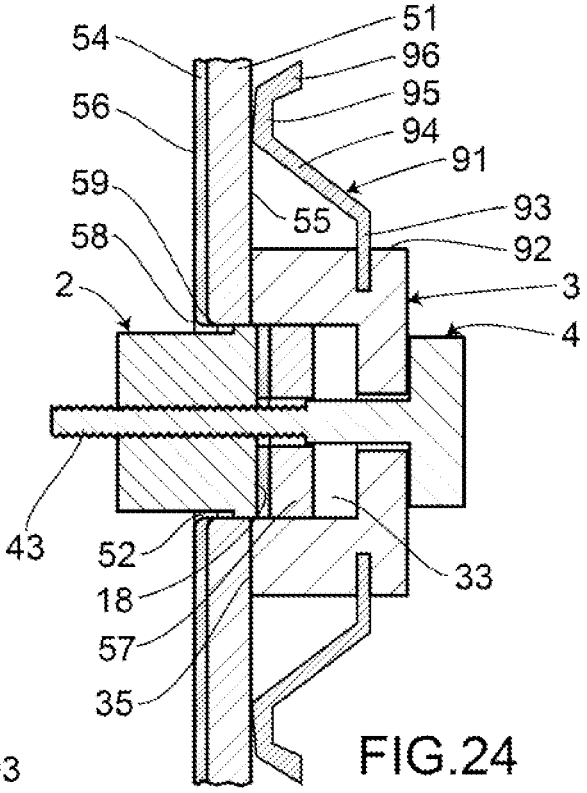
FIG. 24 is a cross-sectional view of the drilling jig and the bumper thereof, with the bumper being in the process of being punched out.
Figure 25:
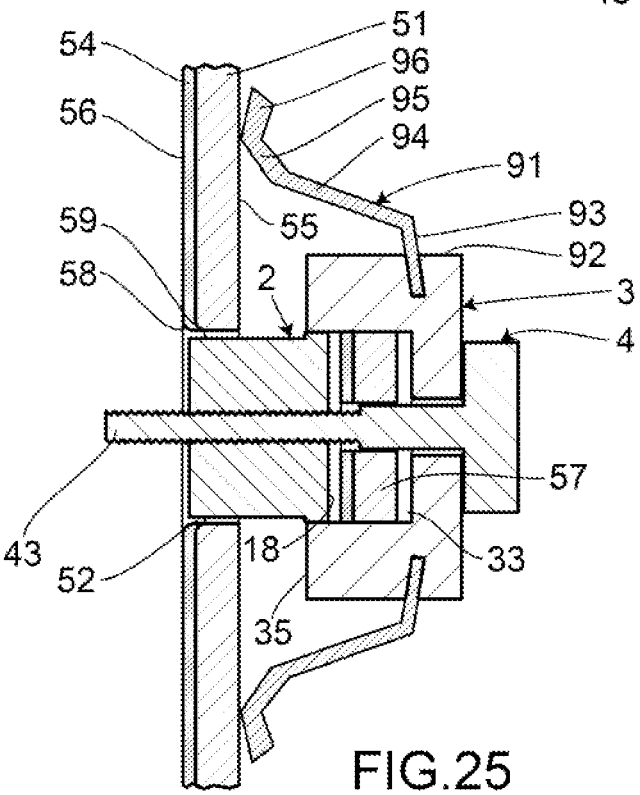
FIG. 25 is a cross-sectional view of the drilling jig and the bumper thereof, with the bumper having been punched out.

FIG. 23 to FIG. 25 show a fourth embodiment of the present invention. Elements identical to those in the first to the third embodiments are given identical symbols, and the detailed descriptions thereof are thus omitted. As for the drilling jig 1 of this embodiment, the female blade 3 is equipped with a plate spring 91 as a biasing member.

The plate spring 91 is attached to a side portion 92 of the female blade 3. The plate spring 91 is provided at two opposing locations on the housing portion 31 in the radial direction. The plate spring 91 is composed of a fixed portion 93 substantially parallel to the abutting surface 35; an arm portion 94 extending in a direction away from the female blade 3; a supporting portion 95 to be brought into close contact with the rear surface 55 of the bumper 51; and a bent portion 96 that is formed on the tip end side of the supporting portion 95, and is bent in a direction away from the bumper 51. In a state where an external force is not being applied to the plate spring 91, the supporting portion 95 of the plate spring 91 protrudes outward with respect to the abutting surface 35 in the axial direction of the female blade 3.

Here, the setting of the drilling jig 1 of this embodiment will be described. In the beginning, the hexagon bolt 4 will be inserted through the female blade 3 so as to bring the abutting surface 35 of the female blade 3 into close contact with the rear surface 55 of the bumper 51, and allow the male screw portion 43 to be inserted through the tentative hole 53. At that time, the supporting portion 95 of the plate spring 91 will abut against the rear surface 55 of the bumper 51, and the plate spring 91 will thus bow by expanding outward in the radial direction of the female blade 3. In this way, an elastic force of the plate spring 91 will be applied to the rear surface 55 of the bumper 51, thus causing the female blade 3 to be biased in a direction away from the bumper 51. Next, the male blade 2 will be screwed to the male screw portion 43; and once the blade surface 18 has come into close contact with the coated surface 56 of the bumper 51, setting will thus be completed.

Next, described is a method for boring the punching hole 52, using the drilling jig 1 of this embodiment. Here, although the diameter of the punching hole 52 of this embodiment is about 2 cm, the diameter of the punching hole 52 can be any diameter by changing the diameter of the blade portion 20. From a state where the drilling jig 1 is already set, the male blade 2 will be rotated about the hexagon bolt 4 to cut a part of the coating 54. In the beginning, the male blade 2 is rotated about the hexagon bolt 4 so as to be brought closer to the female blade 3. At that time, the hexagon bolt 4 is kept fixed so that the female blade 3 and the hexagon bolt 4 will not rotate. With the blade portion 20 of the male blade 2 abutting against the bumper 51, the rotation of the male blade 2 will cause a given amount of the coating 54 to be cut. Then, the rotation of the male blade 2 will be stopped, and the male blade 2 itself will thus be fixed, leaving a given thickness of the coating 54. Next, with the male blade 2 being fixed so that it will not rotate, the hexagon bolt 4 will be rotated, thereby allowing the blade portion 20 of the male blade 2 and the abutting surface 35 of the female blade 3 to be pushed against the bumper 51 more strongly. By further rotating the hexagon bolt 4, a shear force acting on the bumper 51 will become greater than the shear strength of the bumper 51, thereby causing the bumper 51 to be punched out by the male blade 2. Once the bumper 51 has been punched out, the blade portion 20 of the male blade 2 and the fragments 57 will be received in the blade portion housing hole 33. Further, once the bumper 51 has been punched out, the elastic force of the plate spring 91 will cause the female blade 3 to move in a direction away from the bumper 51. At that time, the male blade 2, the hexagon bolt 4 and the fragments 57 will move together with the female blade 3 due to the elastic force of the plate spring 91. Thus, in this embodiment, by then taking out the drilling jig 1 from the rear surface 55 side of the bumper 51, there will be established a state where the punching hole 52 is already bored. The fragments 57 of the bumper 51 may then simply be taken out of the female blade 3 and then discarded.

As described above, in the case of the drilling jig 1 of this embodiment, the female blade 3 is provided with the plate spring 91, and the plate spring 91 biases the female blade 3 in the direction away from the bumper 51, thereby causing the male blade 2 to move in the direction away from the bumper 51 due to the elastic force of the plate spring 91 after boring the punching hole 52, thus allowing the drilling jig 1 to be easily recovered from the rear surface 55 side of the bumper 51. Further, since the drilling jig 1 moves in a direction substantially perpendicular to the rear surface 55 of the bumper 51, the opening edge portion of the punching hole 52 formed can be prevented from being damaged as the drilling jig 1 comes into close contact therewith.

Fifth Embodiment

Figure 26:
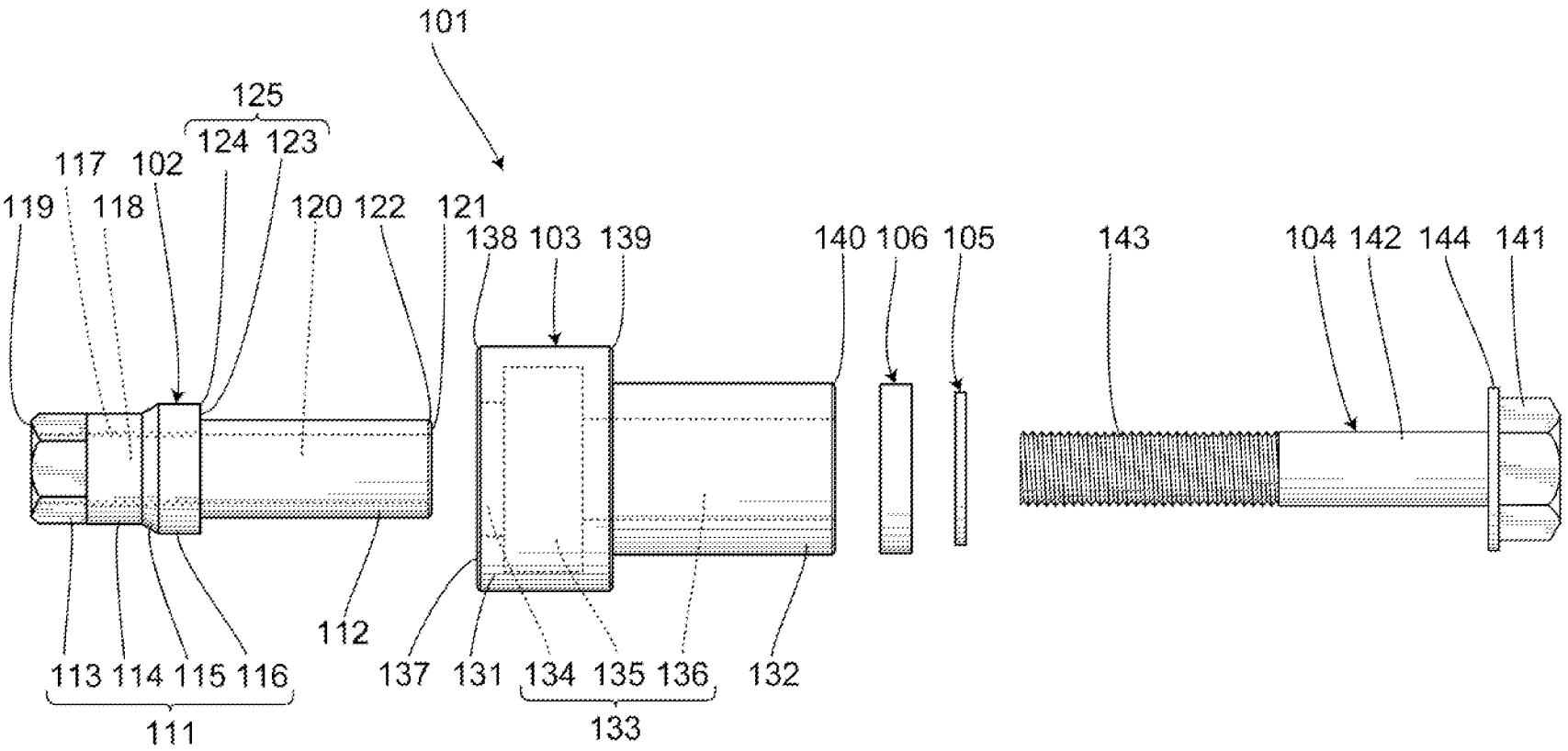
FIG. 26 is an exploded front view showing a drilling jig according to a fifth embodiment of the present invention.

FIG. 26 to FIG. 38 show a fifth embodiment of the present invention. As shown in FIG. 26, a drilling jig 101 of this embodiment includes a male blade 102, a female blade 103, a hexagon bolt 104 as a shaft member, a metal washer 105 and a resin washer 106. The male blade 102, the female blade 103 and the hexagon bolt 104 are made of a quenched steel.

Figure 27:
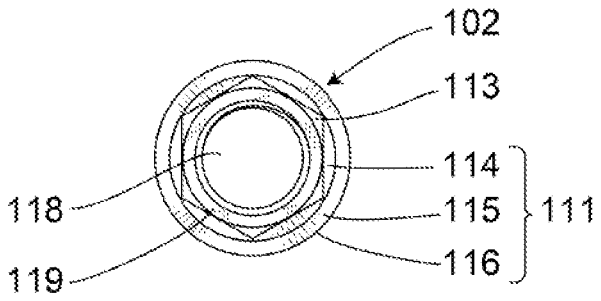
FIG. 27 is a left side view of a male blade thereof.
Figure 28:
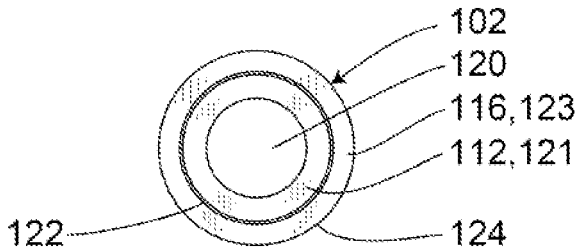
FIG. 28 is a right side view of the male blade thereof.

As shown in FIG. 26 to FIG. 28, the male blade 102 has a male blade main body portion 111 with a blade portion 125 formed thereon; and a cylinder-shaped cylindrical portion 112 to be inserted through the female blade 103. The cylindrical portion 112 is connected to the blade portion 125 of the male blade main body portion 111. At an end portion of the male blade main body portion 111 that is opposite to the blade portion 125, there is provided a hexagonal column-shaped tool latching portion 113 allowing a tool such as a spanner or a wrench to be latched thereonto. Although the tool latching portion 113 of this embodiment is formed into the shape of a hexagonal column, it may also, for example, be formed into other shapes corresponding to the tool to be used, such as the shape of a triangular column and a quadrangular column. The male blade main body portion 111 is composed of an intermediate cylindrical portion 114 formed into the shape of a cylinder; a tapered portion 115 gradually expanded in diameter from the intermediate cylindrical portion 114; and a blade forming portion 116 formed into a cylindrical shape having a diameter larger than that of the intermediate cylindrical portion 114.

Further, bored in the central portion of the male blade main body portion 111 with respect to the radial direction thereof is a screw hole 118 as a shaft coupling hole in which a female screw portion 117 is formed, the female screw portion 117 allowing a male screw portion 143 of the hexagon bolt 104 to be screwed thereto. An end portion 119 of the tool latching portion 113 is opened via the screw hole 118. Further, a shaft insertion hole 120 through which the hexagon bolt 104 can be inserted is bored in the central portion of the cylindrical portion 112 with respect to the radial direction thereof. The screw hole 118 and the shaft insertion hole 120 are communicated with each other, and an end portion 121 of the cylindrical portion 112 that is opposite to the male blade main body portion 111 is opened via the shaft insertion hole 120. A chamfered portion 122 is formed at the outer circumferential corner portion of the end portion 121. A blade surface 123 as an end surface of the blade forming portion 116 formed in an annular shape is formed into a planar shape. This blade surface 123 and a blade corner portion 124 formed on the outer circumferential corner portion of the blade surface 123 compose the blade portion 125. The blade portion 125 is arranged between the cylindrical portion 112 and the tool latching portion 113. Therefore, as a result of inadvertently dropping the male blade 102, either the cylindrical portion 112 or the tool latching portion 113 provided at each end of the male blade 102 will hit the ground first, thereby lowering a possibility for the blade portion 125 to hit the ground. In this way, there can be lowered a possibility for the blade portion 125 to be damaged as a result of dropping the male blade 102.

Figure 29:
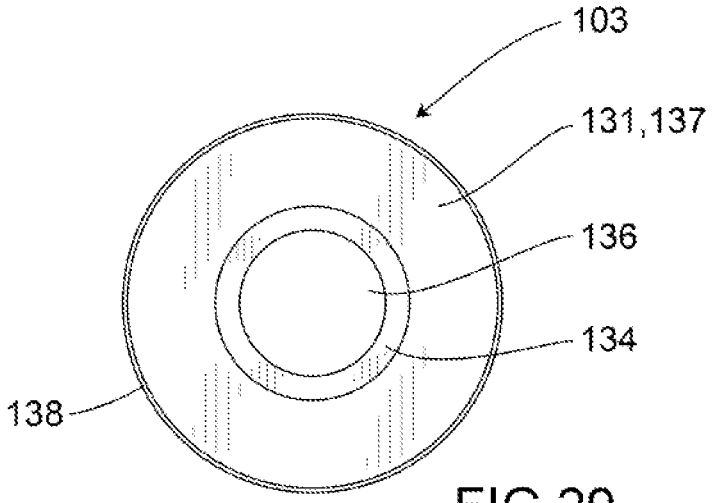
FIG. 29 is a left side view of a female blade thereof.
Figure 30:
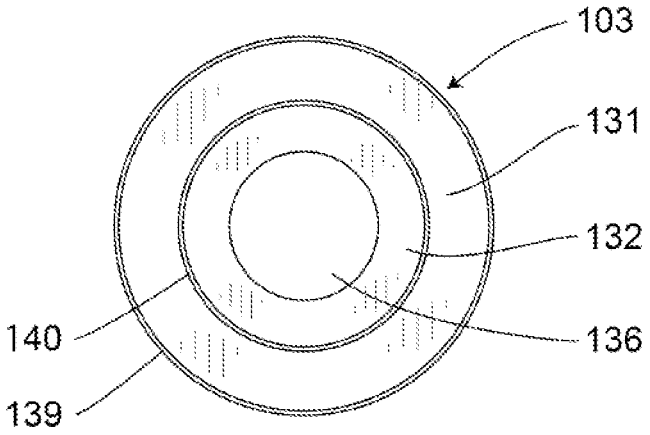
FIG. 30 is a right side view of the female blade thereof.

As shown in FIG. 26, FIG. 29 and FIG. 30, the female blade 103 has a cylindrical housing portion 131; and a base portion 132 formed into a cylindrical shape having a diameter smaller than that of the housing portion 131. A through hole 133 is bored in the central portion of the female blade 103 in the radial direction thereof. This through hole 133 is composed of a blade portion housing hole 134 formed inside the housing portion 131; a fragment housing hole 135 having a diameter larger than that of the blade portion housing hole 134; and a cylindrical portion insertion hole 136 formed inside the housing portion 131 and the base portion 132. The diameter of the blade portion housing hole 134 is formed slightly larger than the outer diameter of the blade forming portion 116 of the male blade 102, thereby allowing the male blade main body portion 111 to be inserted thereinto and taken out therefrom. The diameter of the cylindrical portion insertion hole 136 is formed slightly larger than the outer diameter of the cylindrical portion 112 of the male blade 102, thereby allowing the cylindrical portion 112 to be inserted thereinto and taken out therefrom. Further, the diameter of the cylindrical portion insertion hole 136 is formed smaller than the outer diameter of the blade forming portion 116 and the diameter of the blade portion housing hole 134. An abutting surface 137 as an end surface of the housing portion 131 that is opposite to the base portion 132, is formed into a planar shape. Chamfered portions 138, 139 and 140 are respectively formed on the outer circumferential corner portion of the abutting surface 137, the outer circumferential corner portion of an end surface of the housing portion 131 that is opposite to the abutting surface 137, and the outer circumferential corner portion of an end surface of the base portion 132 that is opposite to the housing portion 131.

As shown in FIG. 26, the hexagon bolt 104 has a head portion 141 formed into the shape of a hexagonal column; a cylindrical shank portion 142; and the male screw portion 143. The head portion 141 is provided with a flange portion 144. A length of the male blade 102 in the longitudinal direction is formed longer than a length of the female blade 103 in the longitudinal direction, and a length of the hexagon bolt 104 in the longitudinal direction is formed longer than the length of the male blade 102 in the longitudinal direction.

Figure 31:
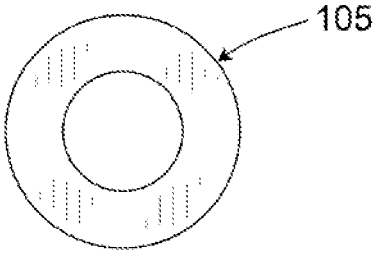
FIG. 31 is a left side view of a metal washer thereof.
Figure 32:
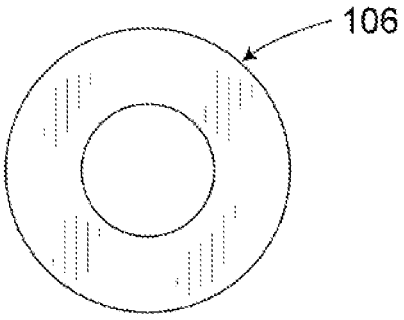
FIG. 32 is a left side view of a resin washer thereof.

As shown in FIG. 26, FIG. 31 and FIG. 32, each of the metal washer 105 and the resin washer 106 is formed into the shape of an annular plate. The outer diameter of the metal washer 105 is smaller than the outer diameter of the resin washer 106, but is substantially identical to the outer diameter of a flange portion 144 of the hexagon bolt 104. The outer diameter of the resin washer 106 is substantially identical to the outer diameter of the base portion 132 of the female blade 103.

Figure 33:
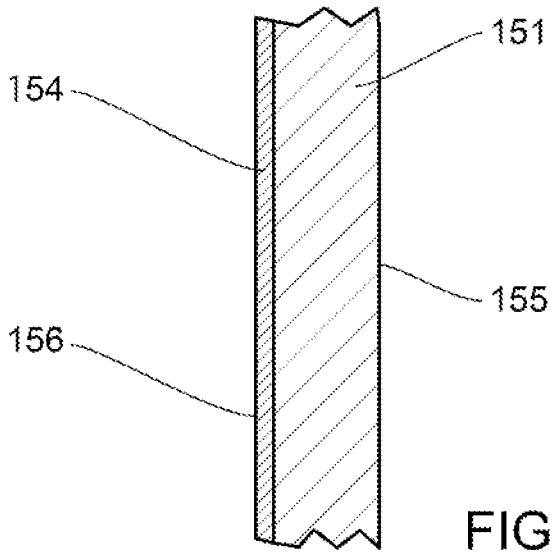
FIG. 33 is a vertical cross-sectional view of a bumper thereof.
Figure 34:
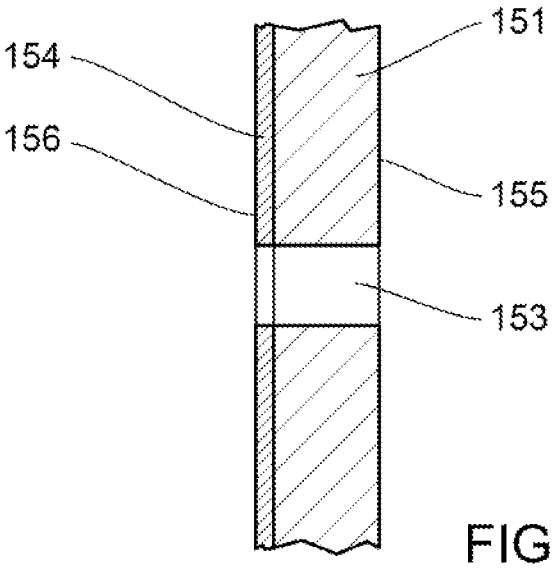
FIG. 34 is a vertical cross-sectional view of the bumper thereof, with a tentative hole bored therein.
Figure 35:
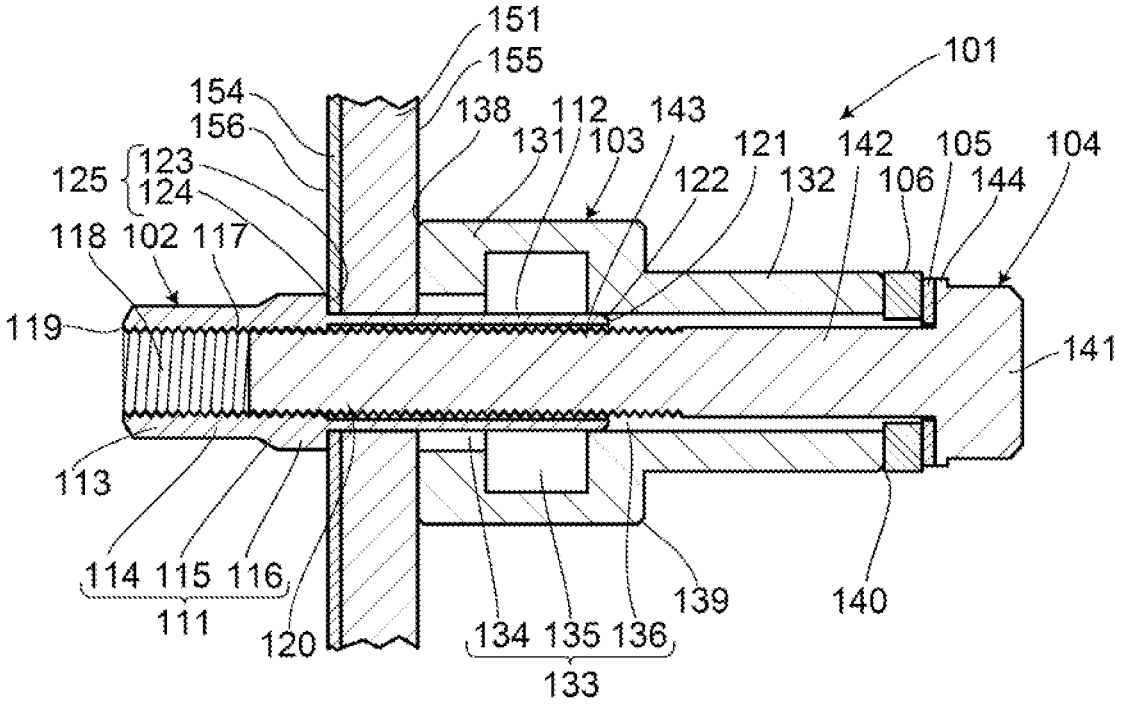
FIG. 35 is a vertical cross-sectional view of the drilling jig and the bumper thereof, with the drilling jig being set on the bumper.

Here, there will be described a method for boring a punching hole 152 in a bumper 151 of a vehicle (not shown), using the drilling jig 101, the bumper 151 thus being an object to be drilled. In the beginning, the setting of the drilling jig 101 will be described. First of all, a tool such as a drill (not shown) is used to bore in the bumper 151 a tentative hole 153 that is smaller than the punching hole 152 to be drilled eventually, and has a diameter through which the cylindrical portion 112 of the male blade 102 can be inserted. FIG. 33 is a cross-sectional view of the bumper 151 before the tentative hole 153 is drilled. FIG. 34 is a cross-sectional view of the bumper 151 in a state where the tentative hole 153 has been drilled. Next the hexagon bolt 104 is inserted through the metal washer 105 and the resin washer 106. At that time, the metal washer 105 is arranged on the head portion 141 side. Next, the hexagon bolt 104 is inserted from the base portion 132 side through the through hole 133 of the female blade 103, and the metal washer 105 and the resin washer 106 will then be sandwiched between the female blade 103 and the flange portion 144 of the hexagon bolt 104. At that time, the hexagon bolt 104 is loosely inserted in the female blade 103, and the hexagon bolt 104 is thus rotatable in the through hole 133 of the female blade 103. Next, the hexagon bolt 104 is inserted through the tentative hole 153 from a rear surface 155 side of the bumper 151, the rear surface 155 serving as a second surface of the bumper 151 and having no coating 154 thereon. In this way, the abutting surface 137 of the housing portion 131 will be brought into contact with and abut against the rear surface 155 of the bumper 151. In this state, the cylindrical portion 112 of the male blade 2 will be inserted through the tentative hole 153 as well as the cylindrical portion insertion hole 136 of the female blade 103 from a coated surface 156 side of the bumper 151, the coated surface 156 serving as a first surface of the bumper 151. Next, the hexagon bolt 104 will be inserted through the shaft insertion hole 120 of the cylindrical portion 112 and the screw hole 118 of the male blade main body portion 111. There, the female screw portion 117 of the male blade 102 and the male screw portion 143 of the hexagon bolt 104 will be screwed together so as to bring the blade surface 123 of the male blade 102 into close contact with the coated surface 156 of the bumper 151, thereby completing the setting of the drilling jig 101. FIG. 35 shows a state where the setting of the drilling jig 101 has been completed.

When setting the drilling jig 101, by inserting the cylindrical portion 112 through the cylindrical portion insertion hole 136, the male blade 102 can be positioned with respect to the female blade 103. That is, even when distortion is observed with the male screw portion 143 of the hexagon bolt 104 due to quenching, the positional relationship between the male blade 102 and the female blade 103 can be hardly affected, thereby reducing the degree of rattling between the male blade 102 and the female blade 103 when screwing together the female screw portion 117 and the male screw portion 143. When screwing together the female screw portion 117 and the male screw portion 143, the male blade 102 may be rotated while keeping the hexagon bolt 104 fixed, the hexagon bolt 104 may be rotated while keeping the male blade 102 fixed, or both the male blade 102 and the hexagon bolt 104 may be rotated. Further, an operator may directly rotate and fix the male blade 102 and the hexagon bolt 104 by hand or using a tool such as a wrench or a spanner (not shown).

Figure 36:
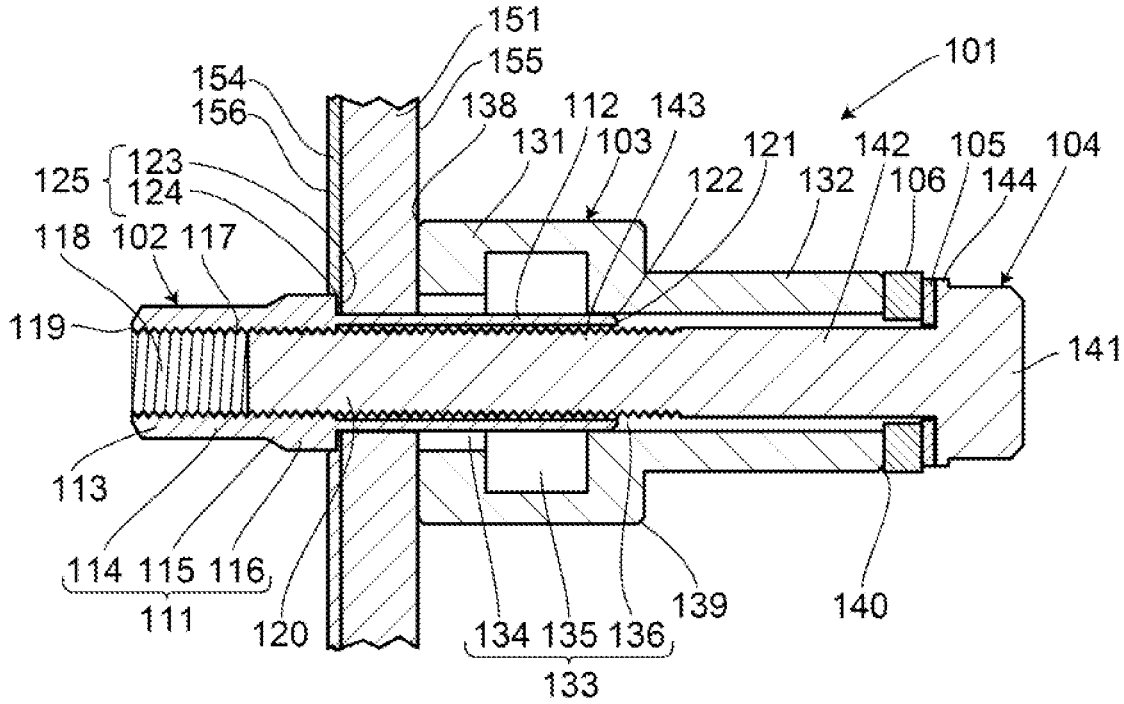
FIG. 36 is a vertical cross-sectional view of the drilling jig and the bumper thereof, with a given amount of the coating having been cut.
Figure 37:
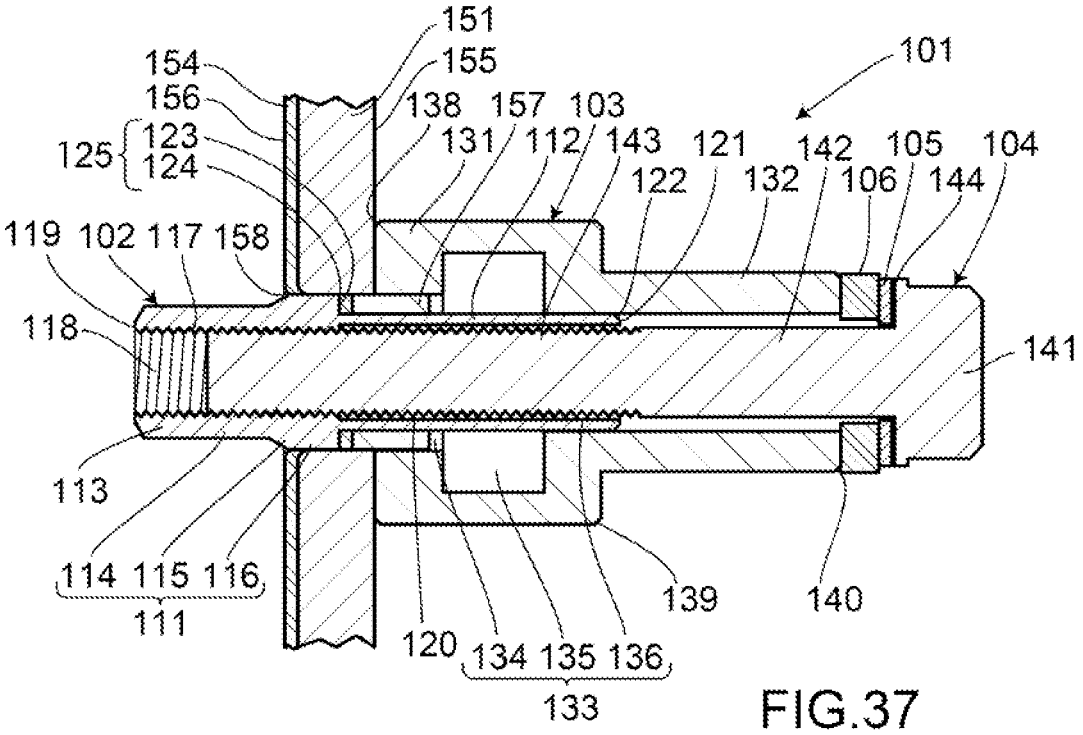
FIG. 37 is a vertical cross-sectional view of the drilling jig and the bumper thereof, with the bumper being in the process of being punched out.
Figure 38:
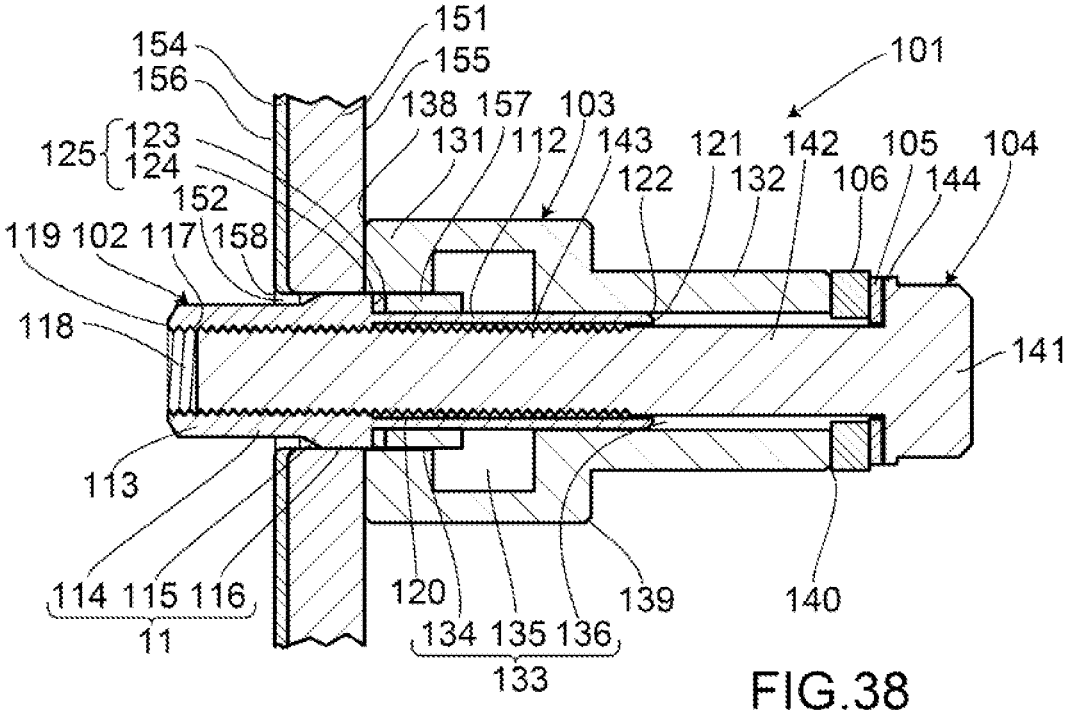
FIG. 38 is a vertical cross-sectional view of the drilling jig and the bumper thereof, with the bumper having been punched out.

Next, described is a method for boring a punching hole 152 in the bumper 151 coated with the coating 154. Here, although the diameter of the punching hole 152 of this embodiment is about 2 cm, the diameter of the punching hole 152 can be any diameter by changing the diameter of the blade portion 125. In the beginning, with the hexagon bolt 104 being fixed so that it will not rotate, the male blade 102 will be rotated about the hexagon bolt 104 to be brought closer to the female blade 103. At that time, the coating 154 on the bumper 151 that is in close contact with the blade portion 125 of the male blade 102 will be cut by a given amount. Then, the rotation of the male blade 102 will be stopped, and the male blade 102 itself will thus be fixed, leaving a given thickness of the coating 154. FIG. 36 shows a state where the coating 154 has been cut off by a given amount, and the rotation of the male blade 102 has been stopped. Next, with the male blade 102 being fixed so that it will not rotate, the hexagon bolt 104 will be rotated to screw the male screw portion 143 of the hexagon bolt 104 into the female screw portion 117 of the male blade 102. At that time, the blade portion 125 of the male blade 102 and the abutting surface 137 of the female blade 103 are to be pressed against the bumper 151 more strongly. Here, the reason that the male blade 102 is to be fixed so that it will not rotate is because there is a need to prevent the coating 154 from being cut more than necessary. By further rotating the hexagon bolt 104, a shear force acting on the bumper 151 will become greater than a shear strength of the bumper 151, thereby causing the bumper 151 to be punched out by the male blade 102. In this way, the drilling of the punching hole 152 using the drilling jig 101 is a so-called shearing process where the male blade 102 serves as a punch, and the female blade 103 serves as a die. When the bumper 151 has been punched out, the blade portion 125 of the male blade 102 will be received in the blade portion housing hole 134, and fragments 157 of the punched bumper 151 will be received in the blade portion housing hole 134 and the fragment housing hole 135. FIG. 37 shows a state where the bumper 151 is being punched out; FIG. 38 shows a state where the bumper 151 has been punched out. In the end, the male blade 102 is rotated about the hexagon bolt 104 so as to unscrew the female screw portion 117 and the male screw portion 143 from each other. There, by pulling out the male blade 102 from the female blade 103 and the punching hole 152, there will be established a state where the punching hole 152 is already bored in the bumper 151. The fragments 157 of the bumper 151 may then simply be taken out of the female blade 103 and then discarded.

In the above method for drilling the punching hole 152, by cutting the coating 154 in a way such that a given amount thereof will be left, the remaining coating 154 when the bumper 151 has been punched out and the basis material of the bumper 151 will be pulled toward the inner side of the punching hole 152 such that an opening corner portion 158 of the coating 154 and an opening corner portion 159 of the bumper 151 will turn into curved shapes. In this way, the opening corner portion 159 of the bumper 151 will be covered by the coating 154 so that no burrs will occur on an opening edge portion of the punching hole 152, thereby resulting in a well-finished condition. Further, since a boundary between the coating 154 and the basis material of the bumper 151 is located inside the punching hole 152, the boundary between the basis material of the bumper 151 and the coating 154 cannot be seen easily when viewed from the outer side of the bumper 151, thus preventing the exterior appearance from being impaired due to the drilling of the punching hole 152. In this embodiment, the thickness of the bumper 151 is 3 mm; the thickness of the coating 154 is 0.050 to 0.052 mm; the screw pitch of the male screw portion 143 of the hexagon bolt 104 is 1.25 mm; and the male blade 102 is rotated about 180° when cutting the coating 154. When the thickness of the coating 154 and and/or the screw pitch are changed, the amount by which the male blade 102 is rotated may simply be determined so as to be able to leave a given amount of the coating 154.

The drilling jig 101 of this embodiment may also be used to bore the punching hole 152 in a bumper 151 that is not coated with the coating 154. The bumper 151 is made of a synthetic resin such as polypropylene (PP) or polycarbonate (PC). If the punching hole 152 is to be bored in such bumper 151 by a shearing technique, distortion will occur at, for example, the opening corner portion 159 of the bumper 151 due to the shear force, and the deformed area(s) will turn white to impair the exterior appearance. Therefore, the surface side of the bumper 151 will be cut by a given amount, by rotating the male blade 102 by a given amount e.g. 360° while keeping the hexagon bolt 104 fixed so that the hexagon bolt 104 will not rotate. Later, the hexagon bolt 104 is rotated while keeping the male blade 102 fixed so that the male blade 102 will not rotate, thereby allowing the male blade 102 to punch out the bumper 151 to form the punching hole 152. Unlike the above case employing the bumper 151 coated with the coating 154, the opening corner portion 159 of the bumper 151 in this case will not turn into a curved shape.

Described hereunder is a method for boring the punching hole 152 in a bumper 151 that is made of a mixture material of polycarbonate (PC) and acrylonitrile styrene acrylate (ASA), and is not coated with the coating 154. The bumper 151 made of the mixture material of PC and ASA has a high hardness, and it is difficult to cut the surface thereof with the male blade 102. Therefore, with the male blade 102 being fixed so that it will not rotate, the hexagon bolt 104 is then rotated to allow the male blade 102 to punch out the bumper 151. The opening corner portion 159 of the bumper 151 will turn into a curved shape, because the opening corner portion 159 is to be pulled toward the inner side of the punching hole 152.

As described above, in the case of the drilling jig 101 of this embodiment, the male blade 102 has the male blade main body portion 111 and the cylindrical portion 112. The male blade main body portion 111 is provided with the screw hole 118 as a shaft coupling hole through which the hexagon bolt 104 can be inserted; and the blade portion 125. The cylindrical portion 112 is provided with the shaft insertion hole 120 through which the hexagon bolt 104 can be inserted. The female blade 103 is provided with the cylindrical portion insertion hole 136 through which the cylindrical portion 112 can be inserted. In this way, after allowing the male blade 102 to uniformly cut the coating 154 applied to the bumper 151, the male blade 102 can then punch out the bumper 151 to form the punching hole 152. Further, since the coating 154 on the opening corner portion 158 of the punching hole 152 is to be pulled toward the inner side of the punching hole 152, the boundary between the basis material of the bumper 151 and the coating 154 is hardly visible from the outside. Furthermore, by inserting the cylindrical portion 112 through the cylindrical portion insertion hole 136, the male blade 102 can be positioned with respect to the female blade 103. That is, even when distortion is observed with the male screw portion 143 of the hexagon bolt 104 due to quenching, the rattling between the male blade 102 and the female blade 103 can be prevented when screwing together the female screw portion 117 and the male screw portion 143.

Further, in the case of the drilling jig 101 of this embodiment, the male blade 102 and the hexagon bolt 104 can be coupled together by inserting the hexagon bolt 104 through the screw hole 118, and then screwing together the female screw portion 117 formed in the male blade 102 and the male screw portion 143 formed on the hexagon bolt 104. Thus, the male blade 102 can be moved by being rotated about the hexagon bolt 104. In addition, the moving distance of the male blade 102 can be adjusted by the amount of rotation of the male blade 102 and the screw pitch.

Further, in the case of the drilling jig 101 of this embodiment, the male blade main body portion 111 is provided with the tool latching portion 113 allowing a tool to be latched thereonto. In this way, a tool such as a spanner or a wrench can be latched onto the tool latching portion 113 so as to fix and rotate the male blade 102.

Further, in the case of the drilling jig 101 of this embodiment, the blade portion 125 is arranged between the cylindrical portion 112 and the tool latching portion 113. Therefore, as a result of inadvertently dropping the male blade 102, either the cylindrical portion 112 or the tool latching portion 113 provided at each end of the male blade 102 will hit the ground first, thereby lowering a possibility for the blade portion 125 to hit the ground. In this way, there can be lowered a possibility for the blade portion 125 to be damaged as a result of dropping the male blade 102.

Further, according to the drilling method of this embodiment, the tentative hole 153 through which the hexagon bolt 104 is to be inserted will be bored in the bumper 151 with the coating 154 being applied to form the coated surface 156. The hexagon bolt 104 inserted through the through hole 133 bored in the female blade 103 will then be inserted through the tentative hole 153 from the rear surface 155 side of the bumper 151. The cylindrical portion 112 will be inserted through the cylindrical portion insertion hole 136, and the male blade 102 will then be screwed to the male screw portion 143 of the hexagon bolt 104, thereby allowing the blade surface 123 to abut against the coated surface 156 of the bumper 151, and the bumper 151 to thus be sandwiched between the male blade 102 and the female blade 103. There, while keeping the hexagon bolt 104 fixed so that it will not rotate, the male blade 102 will then be brought closer to the female blade 103 by being rotated about the hexagon bolt 104. The blade portion 125 will thus cut a part of the coating 154, and the male blade 102 and female blade 103 will then be brought even closer to each other by rotating the hexagon bolt 104 while keeping the male blade 102 fixed so that the male blade 102 itself will not rotate. In this way, the bumper 151 will be punched out, and the coating 154 applied to the bumper 151 will be cut by the male blade 102 i.e. the punching hole 152 is thus formed by allowing the male blade 102 to punch out the bumper 151. Further, since the coating 154 on the opening corner portion 158 of the punching hole 152 will be pulled toward the inner side of the punching hole 152, the boundary between the basis material of the bumper 151 and the coating 154 becomes hardly visible from the outside, thus preventing the exterior appearance of the bumper 151 from being impaired due to the drilling of the punching hole 152. Moreover, the moving distance of the male blade 102 can be adjusted by the screw pitches of the female screw portion 117 and male screw portion 143 as well as the amount of rotation of the male blade 102; and the amount of the coating 154 to be cut by the male blade 102 can also be determined by the screw pitches of the female screw portion 117 and male screw portion 143 as well as the amount of rotation of the male blade 102.

Sixth Embodiment

Figure 39:
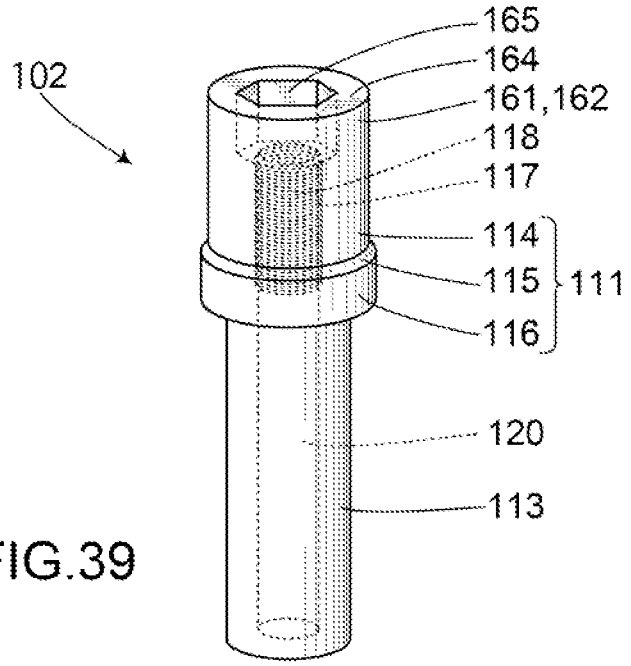
FIG. 39 is a perspective view of a male blade according to a sixth embodiment of the present invention.
Figure 40:
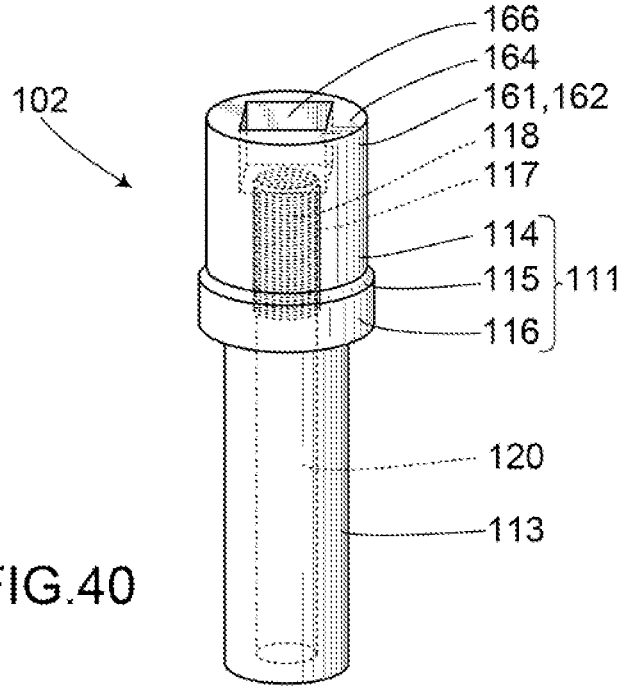
FIG. 40 is a perspective view of a modified embodiment of the male blade thereof.
Figure 41:
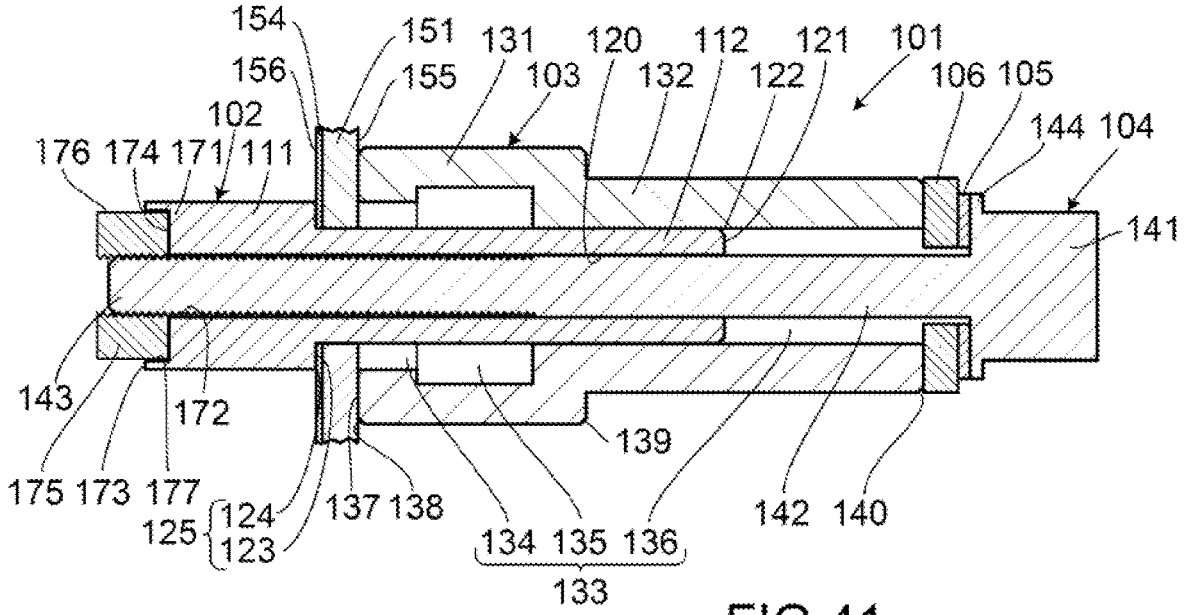
FIG. 41 is a vertical cross-sectional view of a drilling jig and the bumper thereof, with the drilling jig being set on the bumper.
Figure 42:
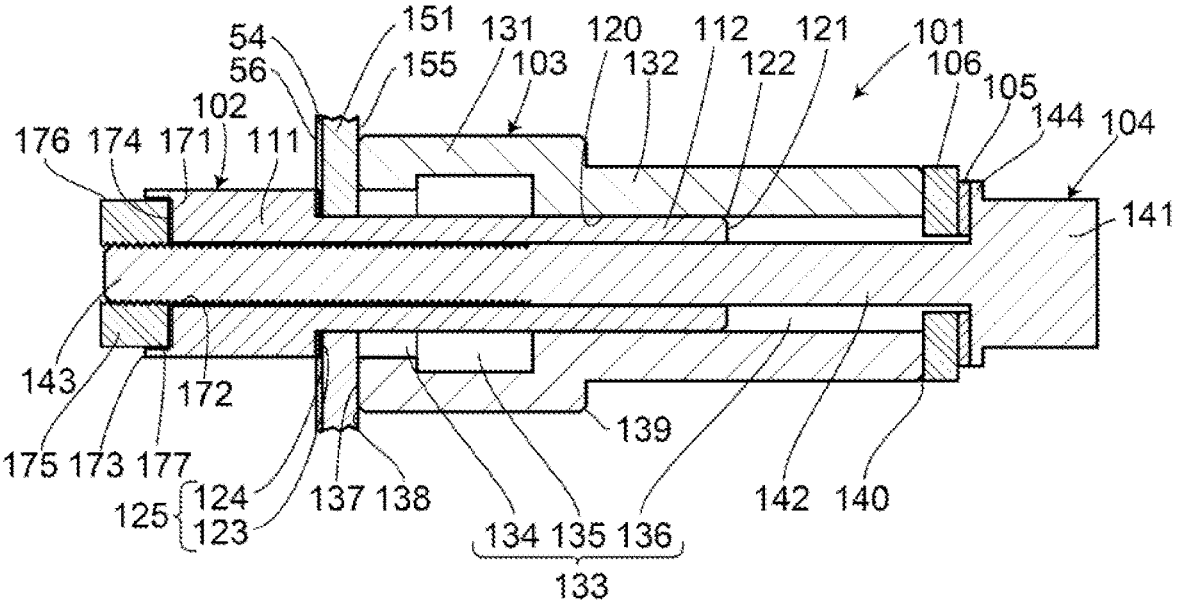
FIG. 42 is a vertical cross-sectional view of the drilling jig and the bumper thereof, with a given amount of the coating having been cut.
Figure 43:
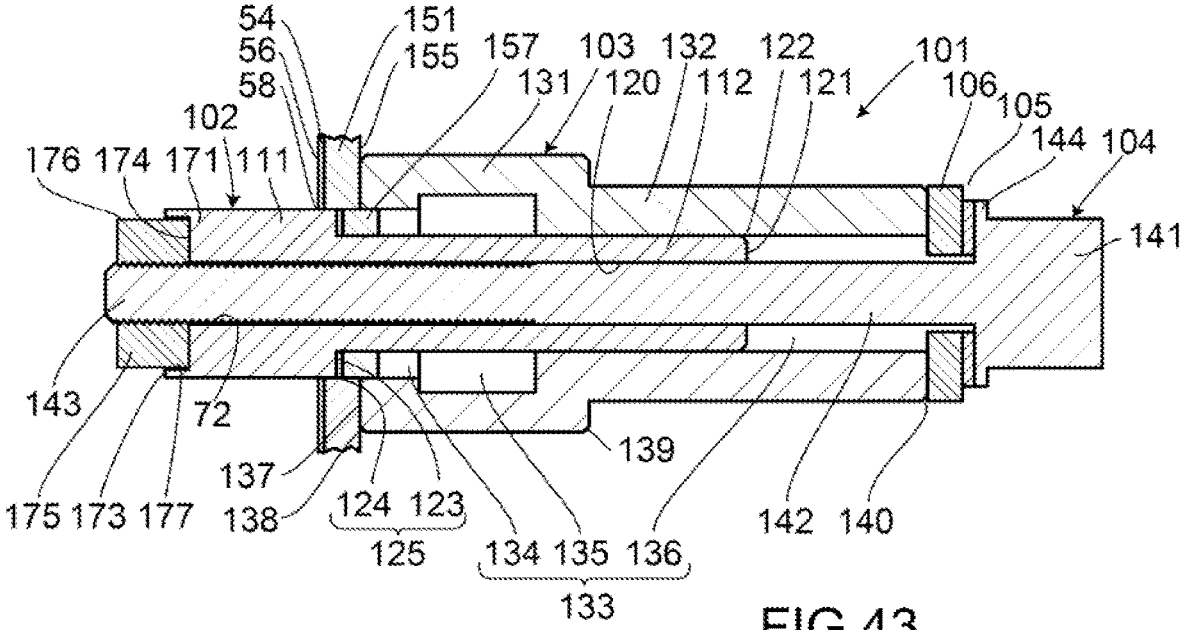
FIG. 43 is a vertical cross-sectional view of the drilling jig and the bumper thereof, with the bumper being in the process of being punched out.
Figure 44:
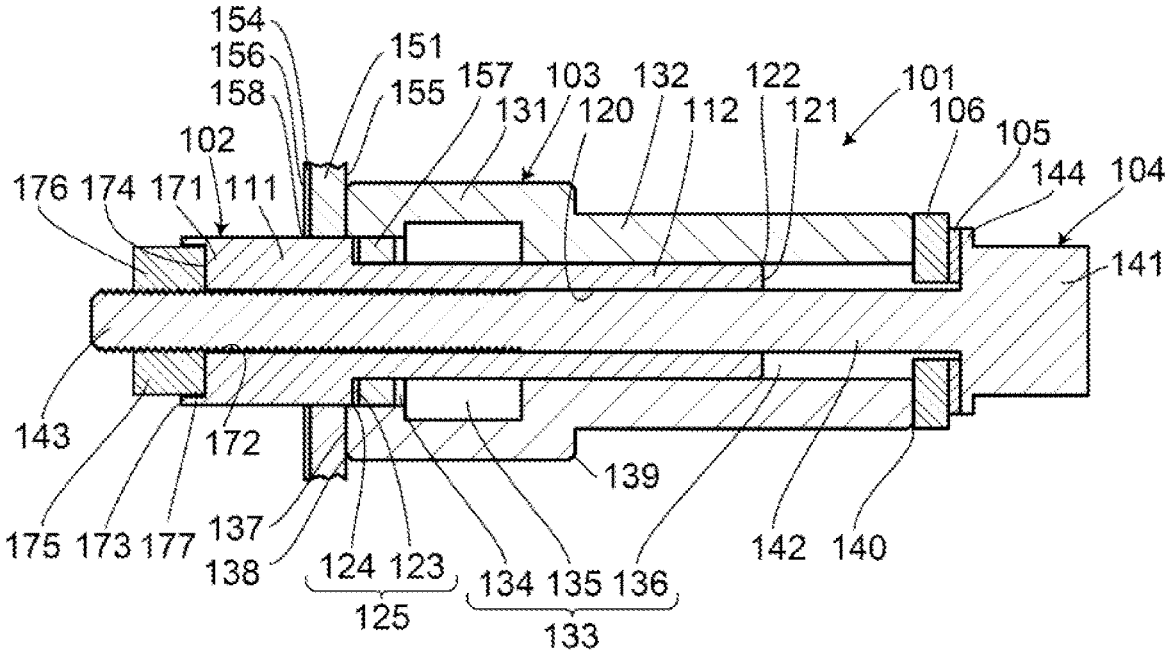
FIG. 44 is a vertical cross-sectional view of the drilling jig and the bumper thereof, with the bumper having been punched out.

FIG. 39 and FIG. 40 show a sixth embodiment of the present invention. Elements identical to those in the fifth embodiment are given identical symbols, and the detailed descriptions thereof are thus omitted. The present embodiment is such that a tool latching portion 161 of the male blade 102 is formed into a cylindrical shape. The outer diameter of the tool latching portion 161 is identical to the outer diameter of the intermediate cylindrical portion 114.

As shown in FIG. 39, a hexagonal hole 165 as a latching hole is formed on an end portion 164 of the tool latching portion 161 that is opposite to the intermediate cylindrical portion 114. The hexagonal hole 165 is formed into a bottomed concave shape having a hexagonal opening. A hexagonal wrench (not shown) can be latched into the hexagonal hole 165, and the male blade 102 can be rotated using such hexagonal wrench.

Further, as shown in FIG. 40, the latching hole formed on the end portion 164 of the tool latching portion 161 may be a rectangular hole 166 formed into a bottomed concave shape and having a rectangular opening. The rectangular hole 166 is configured in a manner such that the male blade 102 can be rotated by latching a wrench part of a ratchet handle (not shown) or spinner handle (not shown) for a socket wrench into the rectangular hole 166.

As described above, in the case of the drilling jig 101 of this embodiment, the cylindrical tool latching portion 161 is formed on the male blade main body portion 111, and the concave hexagonal hole 165 or rectangular hole 166 is formed on the end portion 164 of the tool latching portion 161 in the axial direction. In this way, the male blade 102 can be fixed and rotated by inserting and latching the above-mentioned wrench part of a ratchet handle or spinner handle for a socket wrench into the hexagonal hole 165 or the rectangular hole 166. In addition, since the tool latching portion 161 is formed into a cylindrical shape, even when a side surface 162 of the tool latching portion 161 collides with the opening corner portion 158 of the punching hole 152 at the time of pulling the male blade 102 from the punching hole 152 drilled, the occurrence of damage(s) to the opening corner portion 158 can be restricted.

Seventh Embodiment

FIG. 41 to FIG. 44 show a seventh embodiment of the present invention. Elements identical to those in the fifth and sixth embodiments are given identical symbols, and the detailed descriptions thereof are thus omitted. According to the drilling jig 101 of this embodiment, instead of the tool latching portion 113 employed in the fifth embodiment, there is provided a cylindrical nut housing portion 171. Further, the female screw portion 117 of the fifth embodiment is not provided in a bolt insertion hole 172 formed in the central portion of the male blade 102 with respect to the radial direction. The male blade 102 will be coupled to the hexagon bolt 104 by screwing together a hexagon nut 175 as a nut housed in the nut housing portion 171 and the hexagon bolt 104. Here, the male blade main body portion 111 is formed into a cylindrical shape as a whole.

A nut housing hole 174 as a bottomed hole having a hexagonal opening is formed on an end portion 173 of the nut housing portion 171 that is opposite to the cylindrical portion 112, this nut housing hole 174 is capable of housing the hexagon nut 175. The drilling jig 101 of this embodiment is designed in a way such that with the hexagon nut 175 being housed in the nut housing hole 174, an outer circumferential portion 176 of the hexagon nut 175 is thus latched onto an inner circumferential portion 177 of the nut housing portion 171, thereby preventing the hexagon nut 175 from rotating inside the nut housing hole 174. Although the nut housing hole 174 of this embodiment has a depth allowing a part of the hexagon nut 175 to be exposed therefrom when the hexagon nut 175 is housed therein, the nut housing hole 174 may instead have a depth allowing the entire hexagon nut 175 to be housed therein. While the hexagon nut 175 is used in this embodiment, a nut having a different shape may be used instead. In such case, the shape of the nut housing hole 174 shall be determined in accordance with the shape of the nut so that the nut will not rotate in the nut housing hole 174.

Here, the setting of the drilling jig 101 of this embodiment will be described. The hexagon bolt 104 is to be inserted through the metal washer 105 and the resin washer 106, and then through the female blade 103. Then, the hexagon bolt 104 will be inserted through the tentative hole 153 of the bumper 151 so as to bring the abutting surface 137 of the female blade 103 into close contact with the rear surface 155 of the bumper 151. Next, the hexagon bolt 104 will be inserted through the bolt insertion hole 172 of the male blade 102 with the hexagon nut 175 already being housed in the nut housing hole 174 of the nut housing portion 171; the male blade 102 will be inserted through the tentative hole 153 from the coated surface 156 side of the bumper 151; and the cylindrical portion 112 of the male blade 102 will then be inserted through the cylindrical portion insertion hole 136 of the female blade 103 so as to bring the blade surface 123 of the male blade 102 into close contact with the coated surface 156 of the bumper 151. At that time, the male screw portion 143 of the hexagon bolt 104 and the hexagon nut 175 will be screwed together As described above, in the case of the drilling jig 101 of this embodiment, the male blade 102 is provided with the nut housing portion 171 capable of housing the hexagon nut 175 which is to be screwed to the male screw portion 143. In this way, the male blade 102 and the hexagon bolt 104 can be screwed and coupled together by the hexagon nut 175 even when the female screw portion 117 is not provided in the screw hole 118 of the female blade 102. Further, a high versatility can be achieved since there are employed the hexagon bolt 104 and the hexagon nut 175 i.e. access to replacement parts is easy when the hexagon bolt 104 or the hexagon nut 175 is lost or to be replaced.

Here, the present invention is not limited to the above embodiments, and various modified embodiments are feasible within the scope of the gist of the present invention. For example, the shapes of the intermediate cylindrical portion, tapered portion, housing portion and base portion may be appropriately changed to any shapes other than a cylindrical shape e.g. a square tubular shape. In addition, the biasing member for biasing the female blade may be a member other than a plate spring.

The invention claimed is:

1. A drilling jig comprising a male blade, a female blade and a shaft member, wherein the male blade and the shaft member are capable of being coupled to each other, the male blade has a shaft coupling hole for inserting the shaft member thereinto, a blade portion, and a tool latching portion for allowing a manually operated tool to be latched thereonto, the blade portion has a planar blade surface for uniformly cutting a coating applied to a one-side surface of a workpiece to be bored, and for performing a shearing process on the workpiece, and the female blade has a shaft insertion hole for inserting the shaft member therethrough, and a blade portion housing hole capable of housing the blade portion, wherein the planar blade surface is perpendicular to a longitudinal axis of the shaft member when the male blade and the shaft member are coupled to each other, the blade portion cuts a part of the coating, and the male blade and the female blade are allowed to come closer to each other by rotating the shaft member with the male blade being fixed so as not to be rotated, thereby punching the workpiece.

2. The drilling jig according to claim 1, wherein the male blade and the shaft member are capable of being coupled to each other, by inserting the shaft member into the shaft coupling hole such that a female screw portion formed in the male blade and a male screw portion formed in the shaft member are threadably engaged with each other.

3. The drilling jig according to claim 1, wherein the shaft member is a hexagon socket bolt, a hexagon bolt, or a hexagon socket bolt with a hexagonal column-shaped head portion.

4. The drilling jig according to claim 1, wherein the shaft member has a guide portion that is capable of being inserted into the shaft insertion hole.

5. The drilling jig according to claim 1, wherein the shaft member has a shaft portion and a head portion that are attachable to and detachable from each other, and includes a rotation prevention member that regulates the rotation of the shaft portion inside the shaft insertion hole.

6. The drilling jig according to claim 1, wherein the female blade is provided with a biasing member that biases the female blade toward a direction away from the workpiece to be punched.

7. A method for drilling a punching hole using the drilling jig according to claim 1, comprising:

drilling a tentative hole in the workpiece for the shaft member to be inserted through the tentative hole, the workpiece being to be bored;

inserting the shaft member, which has been inserted into the shaft insertion hole, into the tentative hole from an other-side of the workpiece;

allowing the female blade to abut against the workpiece;

coupling the male blade and the shaft member to each other;

allowing the blade surface to abut against the one-side surface of the workpiece;

sandwiching the workpiece by the male blade and the female blade;

bringing the male blade closer to the female blade by rotating the male blade about the shaft member with the shaft member being fixed so as not to be rotated to cut, a part of the coating by the blade portion, and stopping rotation of the male blade to leave remaining part of the coating; and allowing the male blade and the female blade to come closer to each other by rotating the shaft member with the male blade being fixed so as not to be rotated to pull the remaining part of the coating toward an inner side of the blade portion housing hole such that a boundary between the coating and the workpiece is moved toward the inner side of the blade portion housing hole, thereby punching the workpiece.

8. A method for drilling a punching hole using the drilling jig according to claim 5, comprising:

drilling a tentative hole in the workpiece for the shaft portion to be inserted through the tentative hole, the workpiece being to be punched;

inserting the shaft portion, which has been inserted into the shaft insertion hole, into the tentative hole from an other-side of the workpiece;

allowing the female blade to abut against the workpiece;

coupling the male blade and the shaft portion to each other;

allowing the male blade to abut against the one-side surface of the workpiece;

sandwiching the workpiece by the male blade and the female blade;

bringing the male blade closer to the female blade by rotating the male blade about the shaft portion with the shaft portion being fixed so as not to be rotated, thereby cutting a part of the coating by the blade portion; and allowing the male blade and the female blade to come closer to each other by rotating the head portion about the shaft portion with the male blade and the shaft portion being fixed so as not to be rotated, thereby punching the workpiece.

9. The drilling jig according to claim 1, wherein the male blade has a male blade main body and a cylindrical portion, the male blade main body has the shaft coupling hole for inserting the shaft member therethrough, and the blade portion, the cylindrical portion has the shaft insertion hole for inserting the shaft member therethrough, and the female blade has a cylindrical portion insertion hole for inserting the cylindrical portion therethrough.

10. The drilling jig according to claim 9, wherein the male blade and the shaft member are capable of being coupled to each other, by inserting the shaft member into the shaft coupling hole to allow the female screw portion formed in the male blade and the male screw portion formed in the shaft member to threadably engage with each other.

11. The drilling jig according to claim 9, wherein the male blade main body has a tool latching portion for allowing a tool to be latched therein.

12. The drilling jig according to claim 9, wherein the male blade main body has a cylindrical tool latching portion, and a concave latching hole is formed at one end of the tool latching portion in an axial direction thereof.

13. The drilling jig according to claim 9, wherein a nut housing portion capable of housing a nut that threadably engages with the male screw portion is formed in the male blade.

14. The drilling jig according to claim 10, wherein the blade portion is arranged between the cylindrical portion and the tool latching portion.

15. A method for drilling a punching hole using the drilling jig according to claim 9, comprising:

drilling a tentative hole in the workpiece for the shaft member to be inserted through the tentative hole, the workpiece being to be punched;

inserting the shaft member, which has been inserted into a through-hole formed through the female blade, into the tentative hole from an other-side of the workpiece;

inserting the cylindrical portion into the cylindrical portion insertion hole, while allowing the male blade to engage with the male screw portion of the shaft member;

allowing the blade surface to abut against the one-side surface of the workpiece;

sandwiching the workpiece by the male blade and the female blade;

allowing the male blade to come closer to the female blade by rotating the male blade about the shaft member with the shaft member being fixed so as not to be rotated, thereby cutting a part of the coating by the blade portion; and allowing the male blade and the female blade to come closer to each other by rotating the shaft member with the male blade being fixed so as not to be rotated, thereby punching the workpiece.

* * * * *